US009618864B2

(12) United States Patent
Sugiura et al.

(10) Patent No.: US 9,618,864 B2
(45) Date of Patent: Apr. 11, 2017

(54) TONER, IMAGE FORMING APPARATUS, IMAGE FORMING METHOD, PROCESS CARTRIDGE, AND DEVELOPER

(71) Applicants: Hideki Sugiura, Shizuoka (JP); Yuka Mizoguchi, Shizuoka (JP); Mio Kumai, Shizuoka (JP)

(72) Inventors: Hideki Sugiura, Shizuoka (JP); Yuka Mizoguchi, Shizuoka (JP); Mio Kumai, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 182 days.

(21) Appl. No.: 14/330,109

(22) Filed: Jul. 14, 2014

(65) Prior Publication Data

US 2015/0072277 A1 Mar. 12, 2015

(30) Foreign Application Priority Data

Sep. 6, 2013 (JP) ..... 2013-185446
Mar. 31, 2014 (JP) ..... 2014-071853

(51) Int. Cl.
*G03G 9/087* (2006.01)
*G03G 9/08* (2006.01)
*G03G 9/093* (2006.01)

(52) U.S. Cl.
CPC ..... *G03G 9/08755* (2013.01); *G03G 9/0806* (2013.01); *G03G 9/0819* (2013.01); *G03G 9/0825* (2013.01); *G03G 9/0827* (2013.01); *G03G 9/08795* (2013.01); *G03G 9/08797* (2013.01); *G03G 9/093* (2013.01); *G03G 9/09392* (2013.01)

(58) Field of Classification Search
CPC ..... G03G 9/08755; G03G 9/0825
USPC ..... 430/109.4, 111.4
See application file for complete search history.

(56) References Cited

U.S. PATENT DOCUMENTS

2005/0112488 A1* 5/2005 Yamada ..... G03G 9/0804 430/108.7
2006/0057488 A1 3/2006 Inoue et al.
2012/0064447 A1 3/2012 Hozumi et al.
2013/0244162 A1* 9/2013 Yamada ..... G03G 9/08755 430/108.2

(Continued)

FOREIGN PATENT DOCUMENTS

JP 62-070859 4/1987
JP 2006-084743 3/2006

(Continued)

OTHER PUBLICATIONS

English language machine translation of JP 2011-145587 (Jul. 2011).*

*Primary Examiner* — Christopher Rodee
(74) *Attorney, Agent, or Firm* — Oblon, McClelland, Maier & Neustadt, L.L.P.

(57) ABSTRACT

A toner comprised of mother toner particles each including a colorant, a resin A capable of forming a crystalline structure, and a resin B incapable of forming a crystalline structure is provided. The resin A is dispersed in the resin B in the state of phase separation. The long axis of each dispersed particle of the resin A has a length of from 30 to 200 nm and the length ratio of the long axis to the short axis is from 2 to 15. The DSC endothermic quantity attributable to the resin A is from 8 to 20 J/g.

16 Claims, 5 Drawing Sheets

(56) References Cited

U.S. PATENT DOCUMENTS

| | | | | |
|---|---|---|---|---|
| 2013/0252160 | A1* | 9/2013 | Nagayama | G03G 9/08755 430/108.2 |
| 2013/0260302 | A1* | 10/2013 | Nakajima | G03G 9/08755 430/108.2 |
| 2013/0260307 | A1* | 10/2013 | Nagayama | G03G 9/081 430/109.31 |
| 2014/0342283 | A1* | 11/2014 | Yamamoto | G03G 9/0819 430/109.4 |
| 2015/0227066 | A1* | 8/2015 | Sugiura | G03G 9/0804 430/110.2 |

FOREIGN PATENT DOCUMENTS

| | | | | |
|---|---|---|---|---|
| JP | 2006-145725 | | 6/2006 | |
| JP | 2007-233169 | | 9/2007 | |
| JP | 2011145587 | A * | 7/2011 | |
| JP | 2012-063496 | | 3/2012 | |
| JP | 2014-052571 | | 3/2014 | |
| JP | WO 2014038644 | A1 * | 3/2014 | G03G 9/0804 |

* cited by examiner

TONER, IMAGE FORMING APPARATUS, IMAGE FORMING METHOD, PROCESS CARTRIDGE, AND DEVELOPER

CROSS-REFERENCE TO RELATED APPLICATIONS

This patent application is based on and claims priority pursuant to 35 U.S.C. §119(a) to Japanese Patent Application Nos. 2013-185446 and 2014-071853, filed on Sep. 6, 2013 and Mar. 31, 2014, respectively, in the Japan Patent Office, the entire disclosure of each of which is hereby incorporated by reference herein.

BACKGROUND

Technical Field

The present disclosure relates to a toner for developing electrostatic images, an image forming apparatus, an image forming method, a process cartridge, and a developer.

Description of the Related Art

In image forming apparatuses such as electrophotographic apparatuses and electrostatic recording apparatuses, an image is formed by developing an electrostatic latent image formed on a photoreceptor into a toner image with toner; transferring the toner image onto a recording medium such as paper; and fixing the toner image thereon by application of heat. A full-color image is generally formed by transferring four toner images of black, yellow, magenta, and cyan onto a recording medium to superimpose them one another, heating the superimposed toner images to melt them simultaneously, and fixing the composite color image on the recording medium.

Toner is required to be fixable at much lower temperatures to achieve an objective of global environmental load reduction. One approach for improving low-temperature fixability of toner involves lowering softening characteristics of the toner, but this approach causes a decrease in heat-resistant storage stability of the toner. When such a toner with poor heat-resistant storage stability is melted under high-temperature and high-humidity environment and then returned to room temperature, the toner will be solidified and unable to exert its inherent fluidity. Moreover, such a toner is likely to melt and slightly adhere to fixing members at around the upper limit temperature of the fixable temperature range (this phenomenon is hereinafter referred to as "hot offset"). It is very difficult for toner to achieve a good balance between low-temperature fixability and heat-resistant storage stability.

Toner is also required to be fixable on various kinds of recording media at low temperatures. For example, in a case in which a toner exists on a concave portion of paper having a large degree of surface roughness and cannot receive sufficient pressure from a fixing member, it is preferable that the toner can spread to some extent only by heat from the fixing member to increase the contact area with the paper, which prevents generation of abnormal images such as slight-amount cold offset. Toner is required to have adaptability to various kinds of recording media with high reliability.

SUMMARY

In accordance with some embodiments, a toner is provided. The toner is comprised of mother toner particles each including a colorant, a resin A capable of forming a crystalline structure, and a resin B incapable of forming a crystalline structure, wherein the resin A is dispersed in the resin B in the state of phase separation, the long axis of each dispersed particle of the resin A has a length of from 30 to 200 nm and the length ratio of the long axis to the short axis is from 2 to 15, and the DSC endothermic quantity attributable to the resin A is from 8 to 20 J/g.

In accordance with some embodiments, an image forming apparatus is provided. The image forming apparatus includes a tandem developing device and a fixing device. The tandem developing device includes at least four developing units arranged in tandem and each of the developing units forms a visible image with the above toner having a different color. The fixing device fixes the visible image on a recording medium with a fixing medium by application of heat and pressure. The system speed is from 200 to 3,000 mm/sec, surface pressure of the fixing medium is from 10 to 3,000 N/cm$^2$, and fixing nip time is from 30 to 400 msec.

In accordance with some embodiments, an image forming method is provided. The method includes forming a visible image with at least four developing units arranged in tandem. Each of the developing units forms a visible image with the above toner having a different color. The method further includes fixing the visible image on a recording medium with a fixing medium by application of heat and pressure. The system speed is from 200 to 3,000 mm/sec, surface pressure of the fixing medium is from 10 to 3,000 N/cm$^2$, and fixing nip time is from 30 to 400 msec.

In accordance with some embodiments, a process cartridge is provided. The process cartridge includes a latent image bearing member, a developing device, and the above toner. The process cartridge integrally supports the latent image bearing member and the developing device and is detachably attachable to image forming apparatus.

In accordance with some embodiments, a two-component developer is provided. The two-component developer includes the above toner and a magnetic carrier.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
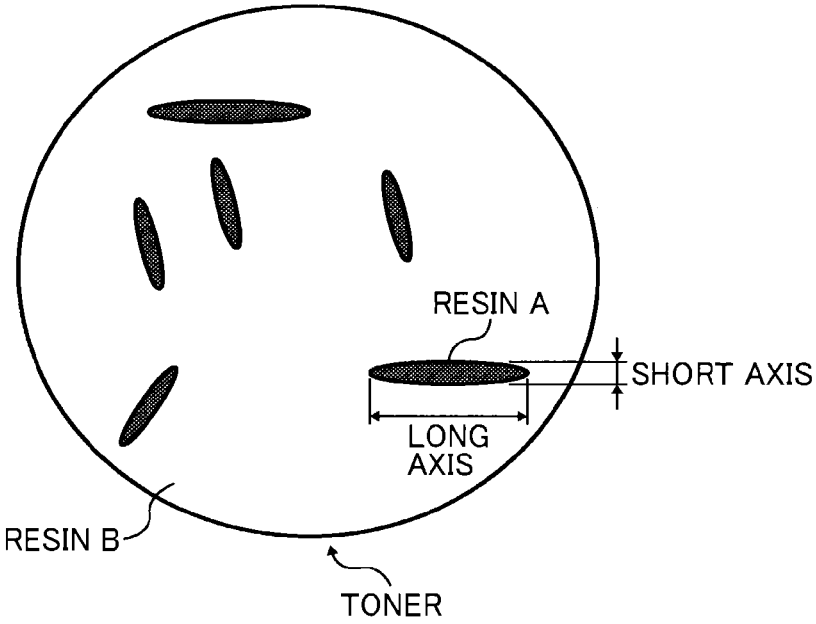
FIG. 1 is a conceptional view of a mother toner particle according to an embodiment, having a sea-island structure wherein a resin capable of forming a crystalline structure is dispersed in another resin incapable of forming a crystalline structure in the state of phase separation.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

For the sake of simplicity, the same reference number will be given to identical constituent elements such as parts and materials having the same functions and redundant descriptions thereof omitted unless otherwise stated.

One object of the present invention is to provide a toner which can achieve an excellent balance of ultimate low-temperature fixability and fluidity even under high-temperature and high-humidity environment and can form images with high reliability.

It is understood from the following detail and specific descriptions that, according to an embodiment of the present invention, a toner is provided which can achieve an excellent balance of ultimate low-temperature fixability and fluidity even under high-temperature and high-humidity environment and can form images with high reliability.

According to further embodiments of the present invention, an image forming apparatus, an image forming method, a process cartridge, and a developer are also provided each having adaptability to high-speed printing with use of the above toner.

The toner according to an embodiment of the invention is comprised of mother toner particles. Each mother toner particle includes a colorant, a resin A capable of forming a crystalline structure, and a resin B incapable of forming a crystalline structure. The resin A is dispersed in the resin B in the state of phase separation. The long axis of each dispersed particle of the resin A has a length of from 30 to 200 nm and the length ratio of the long axis to the short axis is from 2 to 15. The DSC endothermic quantity attributable to the resin A is from 8 to 20 J/g.

Although the mechanism is still being elucidated, several analysis data have led to the following assumptions.

It is preferable that at least the colorant and the resin A are dispersed in the resin B in the state of phase separation, forming a so-called sea-island structure as shown in FIG. 1, which is one example of the phase-separation structures, with the island portions consisting of the resin A capable of forming a crystalline structure. When the long axis of each dispersed particle of the resin A has a length of from 30 to 200 nm and the length ratio of the long axis to the short axis is from 2 to 15, the resin A is able to effectively plasticize (i.e., melt at low temperatures) the surrounding resin B, which is preferable. Accordingly, it is preferable that the resin A has a lower Tg (or a lower melting point) than the resin B.

When the length of the long axis is less than 30 nm, it means that the dispersed particles of the resin A are so small that the plasticization will partially progress even when the toner is melted in non-heating fixing, causing decline of toner fluidity. When the length of the long axis exceeds 200 nm, due to the resulting contact area between the resin A and the resin B, the plasticization will not be effectively accelerated. This means that the resin A cannot exert its function for giving low-temperature fixability to the toner. Moreover, blocks of such particles exceeding 200 nm may cause aggregation of the resin A blocks, causing decline of heat-resistant storage stability of the toner.

The length ratio of the long axis to the short axis is preferably from 2 to 15. When the length ratio is less than 2, it means that crystal growth of the resin A is insufficient and the toner cannot exert sharply-melting property, causing partial plasticization when the toner is melted in non-heating fixing. When the length ratio exceeds 15, it means that crystal growth of the resin A is excessive and the resin A cannot exert its function for giving low-temperature fixability to the toner.

It is preferable that the DSC endothermic quantity attributable to the resin A is from 8 to 20 J/g. When the endothermic quantity is 8 J/g or more, it means that the sharply-melting resin can sufficiently keep sharply-melting property (i.e., crystallinity) in the toner and therefore the toner can sufficiently express low-temperature fixability. Additionally, it can be avoided a situation that the toner expresses no sharply-melting property (i.e., that no resin capable of forming a crystalline structure exists in the toner) due to excessive compatibilization of the resin A with the resin B. In this case, the resin B is not excessively plasticized and therefore decline of toner fluidity can be avoided. When the endothermic quantity is 20 J/g or less, it means that sharply-melting property (i.e., crystallinity) of the resin A is sufficient for giving low-temperature fixability to the toner while decline of toner fluidity is prevented which may be presumably caused by decline of hardness of the resin A.

According to another embodiment, the toner further includes ethyl acetate, as a volatile organic compound, in an amount of from 1 to 30 μg/g. Adhesion of a slight amount of ethyl acetate to the toner has an advantageous effect that melting of the toner is accelerated. This achieves improvement in low-temperature fixability of the toner. When the amount of ethyl acetate is less than 1 μg/g, melting of the toner cannot be accelerated. When the amount of ethyl acetate exceeds 30 μg/g, melting of the toner will be excessively accelerated and toner fluidity will decline.

According to another embodiment, each of the mother toner particles has a core-shell structure. In this embodiment, the toner can be designed to have low-temperature fixability and its fluidity becomes more properly controllable.

According to another embodiment, the toner includes a polyester resin. In this embodiment, the toner can be designed to have low-temperature fixability in a more flexible manner and its particle shape becomes more properly controllable. Because the particle shape has an effect on toner fluidity, decline in toner fluidity can be prevented.

According to another embodiment, the toner includes a modified polyester resin. In this embodiment, the toner can be designed to have low-temperature fixability in a more flexible manner and decline in toner fluidity can be prevented even under high-temperature and high-humidity environment.

According to another embodiment, the toner has an average circularity E of from 0.93 to 0.99. In this embodiment, decline in toner fluidity is more reliably prevented even under high-temperature and high-humidity environment.

According to another embodiment, the weight average particle diameter D4 of the toner is from 2 to 7 μm and the ratio (D4/Dn) of the weight average particle diameter D4 to the number average particle diameter Dn of the toner is from 1.00 to 1.25. In this embodiment, decline in toner fluidity is more reliably prevented even under high-temperature and high-humidity environment.

Such a toner comprising mother toner particles with a high degree of sphericity and a narrow particle size distribution spectrum is easily obtainable by a process including granulating in a medium containing water and/or an organic solvent, to be described in detail later. It is known that determining whether or not a toner has a high degree of sphericity and a narrow particle size distribution spectrum provides an indication of whether the toner is pulverization toner or chemical toner. However, it is to be noted that it does not matter whether the toner according to an embodiment of the invention is pulverization toner or chemical toner. It does not matter how the resin A is dispersed in the resin B or how the crystals of the resin A grow in a solvent in which the resin B is dissolved.

According to an embodiment, the toner is produced by a process including granulating in a medium containing water and/or an organic solvent. This embodiment is preferred in terms of crystalline structure control. The so-called "melt-kneaded pulverization toner", produced by a process including melt-kneading raw materials at high temperatures followed by pulverizing, has a general problem that crystalline resins as the raw materials undergo changes in crystalline structure upon being heated or stressed, making it difficult to control the crystalline structure.

According to another embodiment, the mother toner particles are produced by a dissolution suspension method. In this embodiment, the toner can be designed to have low-temperature fixability and its particle shape becomes more properly controllable. Because the particle shape has an effect on toner fluidity, decline in toner fluidity can be prevented even under high-temperature and high-humidity environment.

According to another embodiment, the mother toner particles are produced by a dissolution suspension method accompanied by an elongation reaction. In this embodiment, the toner can be designed to have low-temperature fixability in a more flexible manner and its particle shape becomes more properly controllable. Because the particle shape has an effect on toner fluidity, decline in toner fluidity can be prevented.

According to another embodiment, the mother toner particles are produced by dispersing and/or emulsifying an organic phase and/or monomer phase in an aqueous medium, where the organic phase and/or monomer phase includes raw materials and/or precursors of the mother toner particles. In this embodiment, the toner can be designed to have low-temperature fixability and decline in toner fluidity can be prevented even under high-temperature and high-humidity environment.

According to another embodiment, the mother toner particles are produced by subjecting a toner composition to a cross-linking and/or elongation reaction in an aqueous medium in the presence of fine resin particles, where the toner composition includes a polymer having a site reactive with a compound having an active hydrogen group, a polyester, a colorant, and a release agent. In this embodiment, the toner can be designed to have low-temperature fixability and decline in toner fluidity can be prevented even under high-temperature and high-humidity environment.

According to another embodiment, it is preferable that the resin A capable of forming a crystalline structure, included in an organic phase consisting of toner materials, is subjected to slow cooling to room temperature for crystal growth and/or annealing treatment (i.e., heat keeping treatment) at a temperature within a range from Tg of the resin B to the melting point of the resin A.

The temperature and time required for the above crystal growth treatment, i.e., slow cooling in the organic phase, depends on various conditions such as the kind and concentration of the resin A or the kind of the solvent. For example, when the resin A is a polyester resin A1, the cooling may start from a temperature at which soluble components can dissolve (typically around the boiling point of the solvent having been elevated due to inclusion of solute) and may terminate at a temperature at which crystals of the resin A have grown to the desired size and shape (typically equals to or below Tg or the deposition temperature of the resin A) over a period of the time required for crystals of the resin A to grow to the desired size and shape (e.g., normally 1 to 80 hours, preferably 2 to 75 hours for the polyester resin A1).

In the latter annealing treatment, the heating temperature and time are controlled so that the resin A becomes to be in the state of phase separation and to have the DSC endothermic quantity described above.

The heating temperature is preferably within a range from Tg of the resin B to the melting point of the resin A (preferably from 30 to 55° C., more preferably 40 to 50° C.). The heating time is preferably from 5 to 36 hours, more preferably from 10 to 24 hours.

According to another embodiment, an image forming apparatus is provided. The image forming apparatus includes a tandem developing device and a fixing device. The tandem developing device includes at least four developing units arranged in tandem and each of the developing units forms a visible image with the above toner having a different color. The fixing device fixes the visible image on a recording medium with a fixing medium by application of heat and pressure. The system speed is from 200 to 3,000 mm/sec, surface pressure of the fixing medium is from 10 to 3,000 N/cm$^2$, and fixing nip time is from 30 to 400 msec. In this image forming apparatus, toner fluidity can be kept in an appropriate range even under high system speeds. Developing members are less contaminated through the developing, transferring, and fixing processes. In the fixing process, the toner is appropriately controlled to deform under high pressure and be melt-fixed on recording media (e.g., paper) without causing hot offset. The fixing nip time being appropriately set, the amount of heat required for toner fixing is appropriately controllable. According to this embodiment, a full-color image forming apparatus can be provided which consumes lower amounts of power and keeps adequate image quality.

According to another embodiment, an image forming method is provided. The method includes forming a visible image with at least four developing units arranged in tandem. Each of the developing units forms a visible image with the above toner having a different color. The method further includes fixing the visible image on a recording medium with a fixing medium by application of heat and pressure. The system speed is from 200 to 3,000 mm/sec, surface pressure of the fixing medium is from 10 to 3,000 N/cm$^2$, and fixing nip time is from 30 to 400 msec.

According to another embodiment, a process cartridge including a latent image bearing member, a developing device, and the above toner is provided. The process cartridge integrally supports the latent image bearing member and the developing device and is detachably attachable to image forming apparatus.

According to another embodiment, a two-component developer including the above toner and a magnetic carrier is provided. In this embodiment, toner fluidity can be kept in an appropriate range even under high temperature and high humidity environment and developing members are less contaminated through the developing and transferring processes. According to this embodiment, a two-component developer with high environmental stability and reliability can be provided.

It is to be noted that any known manufacturing methods and raw materials can be applied to the toner and developer and any known electrophotographic processes can be applied to the image forming apparatus when they satisfy the requirements.

Evaluation of Phase Separation State of Resins

In the present disclosure, phase separation state of the resin A is observed with TEM (transmission electron microscope) in the following manner.

First, a spoonful of toner (by spatula) is embedded in an epoxy resin and the epoxy resin is hardened. The hardened specimen is exposed to a gas of ruthenium tetraoxide, osmium tetraoxide, or another dying agent for 1 minute to 24 hours so as to distinguish resin phases capable of forming a crystalline structure from other phases. The exposure time is adjusted according to the contrast observed. The specimen is cut with a knife to create a cross section and is further cut into ultrathin sections (having a thickness of 200 nm) with an ultramicrotome (ULTRACUT UCT from Leica) using a diamond knife. The ultrathin sections are observed with a TEM (transmission electron microscope H7000 from Hitachi High-Technologies Corporation) at an accelerating voltage of 100 kV. If the resins A and B are distinguishable from each other without dying, dying of the specimen is unnecessary. Composition contrast may be given by another pre-treatment, such as selective etching, prior to the TEM observation. The observed TEM image is subjected to a binarization process etc., with a commercially-available image processing software (e.g., Image-ProPlus), to calculate the length of the long axis of the resin phases capable of forming a crystalline structure and the length ratio between the long axis and short axis. In the calculation, preferably, 50 or more of the resin phases capable of forming a crystalline structure are subjected to the analysis from a quantitative analysis perspective.

Evaluation of DSC Endothermic Quantity

In the present disclosure, DSC endothermic quantity is measured in the following manner.

Measurement is performed by temperature-modulated DSC such as a differential scanning calorimeter Q200 (from TA Instruments). First, about 5.0 mg of toner is put in an aluminum sample container. The container is put on a holder unit and set in an electric furnace. Under nitrogen atmosphere, the sample is heated from 0 to 150° C. at a heating rate of 3° C./min and a modulation cycle of 0.5° C./60 sec to obtain a DSC curve in the 1st heating. The DSC endothermic quantity is determined from "Total Heat Flow" calculated by analyzing the DSC curve with an analysis program TA Universal Analysis (from TA Instruments).

In general, evaluation of endothermic quantity and glass transition temperature of resins are made with the results obtained in the 2nd heating that is a reheating performed after the 1st heating and subsequent cooling. This is because various manufacturing histories given to the resins are canceled in the 1st heating and inherent characteristics of the resins are evaluated in the 2nd heating. By contrast, in the present disclosure, to capture the behavior of the toner during heat-melting process, the above evaluation can be properly made with the results obtained in the 1st heating. Specifically, use of temperature-modulated DSC makes it possible to more precisely evaluate the DSC curve in the 1st heating to more accurately evaluate compatibility of the resin A (capable of forming a crystalline structure) with the resin B (incapable of forming a crystalline structure).

On the other hand, it is possible to determine the endothermic peak attributable to the resin A in the 2nd heating by finding a peak at which the endothermic quantity declines due to dissolving of the resin A in the resin B.

Qualitative and Quantitative Evaluation of Volatile Organic Compounds

Qualitative and quantitative evaluations of volatile organic compounds are preferably made by cryotrap-GCMS method under the following conditions.

1) Instrument: QP2010 from Shimadzu Corporation
   Data analysis software: GCMS solution from Shimadzu Corporation
   Heating device: Py2020D from Frontier Laboratories Ltd.
2) Amount of sample: 10 mg
3) Thermal extraction conditions
   Heating temperature: 180° C.
   Heating time: 15 min
4) Cryotrap: −190° C.
5) Column: Ultra ALLOY-5, L=30 m, ID=0.25 mm, Film=0.25 μm
6) Column heating: 60° C. (keep 1 minute)~10° C./min~130° C.~20° C./min~300° C. (keep 9.5 minutes)
7) Carrier gas pressure: 56.7 KPa (constant)
8) Column flow rate: 1.0 ml/min
9) Ionization method: EI method (70 eV)
10) Mass range: m/z=29~700

Confirmation of Core-Shell Structure of Toner

Confirmation of core-shell structure is preferably made by a method using TEM (transmission electron microscope) in the following manner. The core-shell structure is here defined as a state in which the surface of toner is covered with a component having a different contrast from the inside of the toner. The thickness of the shell layer is preferably 50 nm or more.

First, embed a spoonful of toner (by spatula) in an epoxy resin and harden the epoxy resin. The hardened specimen is exposed to a gas of ruthenium tetraoxide, osmium tetraoxide, or another dying agent for 1 minute to 24 hours so as to distinguish the shell layer from the inside core. The exposure time is adjusted according to the contrast observed. The specimen is cut with a knife to create a cross section and is further cut into ultrathin sections (having a thickness of 200 nm) with an ultramicrotome (ULTRACUT UCT from Leica) using a diamond knife. The ultrathin sections are observed with a TEM (transmission electron microscope H7000 from Hitachi High-Technologies Corporation) at an accelerating voltage of 100 kV. If the shell layer and inside core are distinguishable from each other without dying, dying of the specimen is unnecessary. Composition contrast may be given by another pre-treatment, such as selective etching, prior to the TEM observation.

Average Circularity E

In the present disclosure, the average circularity E is defined by the following equation: E=(the perimeter of the circle having the same area as a projected image of a particle)/(the perimeter of a projected image of the particle)×100%. Measurement is performed with an instrument Flow Particle Image Analyzer (FPIA-2100 from Sysmex Corporation) and analysis is performed with an analysis software (FPIA-2100 Data Processing Program for FPIA version 00-10). Specifically, a 100-ml glass beaker is charged with 0.1 to 0.5 ml of 10% by weight surfactant (an alkylbenzene sulfonate NEOGEN SC-A from Dai-ichi Kogyo Seiyaku Co., Ltd.). Next, 0.1 to 0.5 g of toner is added to the beaker while being mixed with a micro spatula, and further 80 ml of ion-exchange water is added to the beaker. The resultant dispersion is subjected to a dispersion treatment with an ultrasonic disperser (from Honda Electronics) for 3 minutes. The dispersion is subjected to measurement of toner shape and distribution with FPIA-2100 until the dispersion concentration gets 5,000 to 15,000 particles/μl. In this measurement, adjusting the dispersion concentration to 5,000 to 15,000 particles/μl is important from the viewpoint of measurement reproducibility. To achieve the above dispersion concentration, conditions of the dispersion should be adjusted, such as the addition amounts of the surfactant and toner. The addition amount of the surfactant depends on hydrophobicity of the toner. Adding an excessive amount of the surfactant generates bubble noise. Adding an insufficient amount of the surfactant causes the toner to get wet insufficiently, resulting in insufficient dispersion. The addition amount of the toner depends on its particle diameter. The smaller the particle diameter, the smaller the addition amount, and vice versa. When the particle diameter of the toner is from 3 to 7 μm, the addition amount of the toner will be 0.1 to 0.5 g to adjust the dispersion concentration to 5,000 to 15,000 particles/μl.

Weight Average Particle Diameter and D4/Dn (Ratio of Weight Average Particle Diameter to Number Average Particle Diameter)

Weight average particle diameter (D4), number average particle diameter (Dn), and the ratio therebetween (D4/Dn) can be measured with instruments such as Coulter Counter TA-II and Coulter Multisizer II (both from Beckman Coulter, Inc.). In the present disclosure, measurement is performed with Coulter Multisizer II in the following manner.

First, 0.1 to 5 ml of a surfactant (preferably a polyoxyethylene alkyl ether, i.e., nonionic surfactant), as a dispersant, is added to 100 to 150 ml of an electrolyte. Here, the electrolyte is an about 1% NaCl aqueous solution prepared with the first grade sodium chloride, such as ISOTON-II (available from Beckman Coulter, Inc.). Further, 2 to 20 mg of a sample is added thereto. The electrolyte, in which the sample is suspended, is subjected to a dispersion treatment with an ultrasonic disperser for about 1 to 3 minutes and then to measurement of the volume and number of toner particles with the above instrument with a 100-μm aperture to calculate volume and number distributions. Further, the weight average particle diameter (D4) and number average particle diameter (Dn) are calculated from the volume and number distributions.

Thirteen channels with the following ranges are used for the measurement: 2.00 or more and less than 2.52 μm; 2.52 or more and less than 3.17 μm; 3.17 or more and less than 4.00 μm; 4.00 or more and less than 5.04 μm; 5.04 or more and less than 6.35 μm; 6.35 or more and less than 8.00 μm; 8.00 or more and less than 10.08 μm; 10.08 or more and less than 12.70 μm; 12.70 or more and less than 16.00 μm; 16.00 or more and less than 20.20 μm; 20.20 or more and less than 25.40 μm; 25.40 or more and less than 32.00 μm; and 32.00 or more and less than 40.30 μm. Namely, particles having a particle diameter of 2.00 or more and less than 40.30 μm are to be measured.

System Linear Speed

In the present disclosure, the system linear speed is determined by the following formula:

$$B\ (\text{mm/sec}) = 100\ (\text{sheets}) \times 297\ (\text{mm}) \div A\ (\text{sec})$$

wherein A (sec) represents a length of time an image forming apparatus takes for outputting images on 100 sheets of A4 paper (having a longitudinal length of 297 mm) in the longitudinal direction.

Surface Pressure of Fixing Medium

In the present disclosure, the surface pressure of a fixing medium is measured with a pressure distribution measurement system PINCH (from Nitta Corporation).

Fixing Nip Time

The fixing nip time is calculated from the system linear speed and the fixing nip width.

Process Cartridge

Figure 2:
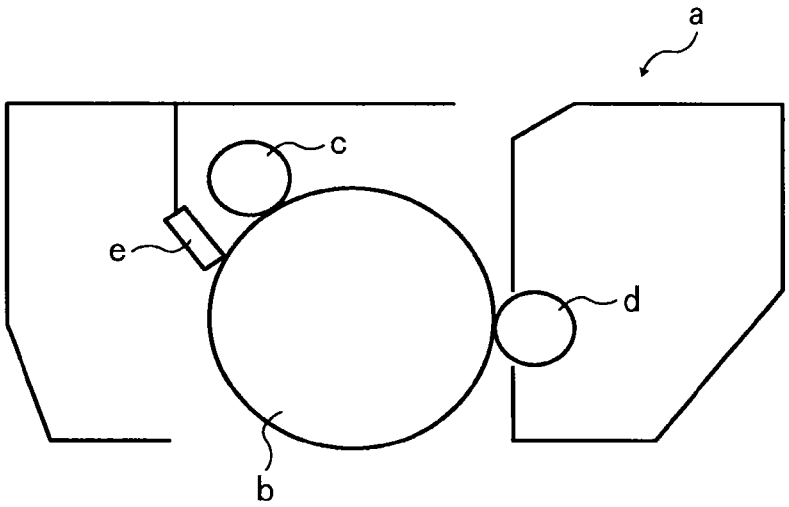
FIG. 2 is a schematic view of a process cartridge according to an embodiment.

FIG. 2 is a schematic view of a process cartridge according to an embodiment. In FIG. 2, a process cartridge (a) includes a photoreceptor (b), a charger (c), a developing device (d), and a cleaner (e).

According to an embodiment, a process cartridge is configured to integrally combine at least the photoreceptor (b) and developing device (d), among the photoreceptor (b), charger (c), developing device (d), and cleaner (e), and to detachably attachable to the main bodies of image forming apparatuses such as copiers and printers.

Resin A Capable of Forming Crystalline Structure and Crystalline Resin

According to an embodiment, the toner preferably includes a crystalline resin as the resin A capable of forming a crystalline structure. The content of the crystalline resin is 10% by weight or more, preferably 20% by weight or more, and most preferably 30% by weight or more, based on total weight of the binder resins.

In the present disclosure, a crystalline substance is defined as a substance in which atoms and molecules are arranged with spatially-repeating patterns, which shows the Bragg angle (diffraction pattern) when measured by an XRD (X-ray diffractometer).

So long as having crystallinity, any resins can be used as the crystalline resin. For example, polyester resin, polyurethane resin, polyurea resin, polyamide resin, polyether resin, vinyl resin, and modified crystalline resin can be used. One or more of these resins can be used in combination. Among these resins, polyester resin, polyurethane resin, polyurea resin, polyamide resin, and polyether resin are preferable. Resins having at least one of urethane or urea skeleton are also preferable. Straight-chain polyester resins and composite resins containing the straight-chain polyester resins are more preferable.

Specific preferred examples of the resins having at least one of urethane or urea skeleton include, but are not limited to, polyurethane resin, polyurea resin, urethane-modified polyester resin, and urea-modified polyester resin. The urethane-modified polyester resin is a resin obtainable by reacting a polyester resin having a terminal isocyanate group with a polyol. The urea-modified polyester resin is a resin obtainable by reacting a polyester resin having a terminal isocyanate group with an amine. The maximum peak temperature of melting heat of the resin capable of forming a crystalline structure is preferably from 45 to 70° C., more preferably from 53 to 65° C., and most preferably from 58 to 62° C., from the viewpoint of balancing low-temperature fixability and heat-resistant storage stability. When the maximum peak temperature falls below 45° C., low-temperature fixability improves but heat-resistant storage stability worsens. When the maximum peak temperature exceeds 70° C., heat-resistant storage stability improves but low-temperature fixability worsens.

Crystalline Polyester Resin

According to an embodiment, the toner preferably includes a crystalline polyester resin in an amount of 10% by weight or more, more preferably 20% by weight or more. The crystalline polyester preferably has a melting point of from 45 to 70° C., more preferably 53 to 65° C., and most preferably from 58 to 62° C. When the melting point falls below 45° C., low-temperature fixability improves but heat-resistant storage stability worsens. When the melting point exceeds 70° C., heat-resistant storage stability improves but low-temperature fixability worsens. The melting point of the crystalline polyester resin is determined from a peak temperature of an endothermic peak obtained by differential scanning calorimetry (DSC).

In the present disclosure, the crystalline polyester resin is defined as a polymer consists of 100% of polyester units or a copolymer of polyester units with at most 50% by weight of other polymer units.

The crystalline polyester resin can be synthesized by, for example, a reaction between a polycarboxylic acid component and a polyol component. Either commercially-available products or laboratory-derived products of the crystalline polyester resins are usable.

Specific examples of usable polycarboxylic acid components include, but are not limited to, aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acids such as phthalic acid, isophthalic acid, terephthalic acid, naphthalene-2,6-dicarboxylic acid, malonic acid, mesaconic acid, and dibasic acids; and anhydrides and lower alkyl esters thereof.

Additionally, tri- or more valent polycarboxylic acids such as 1,2,4-benzenetricarboxylic acid, 1,2,5-benzenetricarboxylic acid, and 1,2,4-naphthalenetricarboxylic acid, and anhydrides and lower alkyl esters thereof are also usable. Two or more of these materials can be used in combination.

The acid components may further include dicarboxylic acids having sulfonic groups other than the above-described aliphatic and aromatic dicarboxylic acids. The acid components may further include dicarboxylic acids having double bonds other than the above-described aliphatic and aromatic dicarboxylic acids.

As the polyol components, aliphatic diols are preferable, and straight-chain aliphatic diols having 7 to 20 carbon atoms in the main chain are more preferable. Branched-chain aliphatic diols are not preferable because they may decrease the crystallinity degree of the polyester resin to cause depression of the melting point. When the number of carbon atoms in the main chain is less than 7 and such a straight-chain aliphatic diol reacts with an aromatic dicarboxylic acid to cause polycondensation, the resulting polyester resin has too high a melting point to provide low-temperature fixability. When the number of carbon atoms in the main chain exceeds 20, it is more difficult to obtain practical materials. Thus, the number of carbon atoms in the main chain is preferably 14 or less.

Specific preferred examples of the aliphatic diols for synthesizing the crystalline polyester include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanediol. Among these materials, 1,8-octanediol, 1,9-nonanediol, and 1,10-decanediol are preferable because they are easily available. Additionally, tri- or more valent polyols such as glycerin, trimethylolethane, trimethylolpropane, and pentaerythritol are also usable. Two or more of these materials can be used in combination.

The content of the aliphatic diol in the polyol components is preferably 80% by mole or more, more preferably 90% by mole or more. When the content of the aliphatic diol is less than 80% by mole, the crystallinity degree of the polyester resin is decreased and the melting point is lowered, causing deterioration of toner blocking resistance, image storage stability, and low-temperature fixability.

For the purpose of adjusting acid value and/or hydroxyl value, polycarboxylic acids and/or polyols may be added in the final stage of the polycondensation reaction, if necessary. Specific examples of usable polycarboxylic acids include, but are not limited to, aromatic carboxylic acids such as terephthalic acid, isophthalic acid, phthalic anhydride, trimellitic anhydride, pyromellitic acid, and naphthalenedicarboxylic acid; aliphatic carboxylic acids such as maleic anhydride, fumaric acid, succinic acid, alkenyl succinic anhydride, and adipic acid; and alicyclic carboxylic acids such as cyclohexanedicarboxylic acid.

Specific examples of usable polyols include, but are not limited to, aliphatic diols such as ethylene glycol, diethylene glycol, triethylene glycol, propylene glycol, butanediol, hexanediol, neopentyl glycol, and glycerin; alicyclic diols such as cyclohexanediol, cyclohexanedimethanol, and hydrogenated bisphenol A; and aromatic diols such as ethylene oxide adduct of bisphenol A and propylene oxide adduct of bisphenol A.

The polycondensation reaction for producing the crystalline polyester resin is performed at a polymerization temperature of from 180 to 230° C. under reduced pressures, if necessary, while removing by-product water or alcohol.

When monomers are incompatible with each other at temperatures below the reaction temperature, a high-boiling-point solvent may be added as a solubilization agent. In this case, the polycondensation reaction is performed while removing the solubilization agent. In copolymerization reaction, if there is a monomer poorly compatible with a main monomer, it is preferable that the poorly-compatible monomer is previously subjected to condensation with an acid or alcohol to be reacted with both of the monomers in advance of polycondensation with the main monomer.

Specific examples of catalysts usable in producing the polyester resins include, but are not limited to, compounds of alkaline metals such as sodium and lithium; compounds of alkaline-earth metals such as magnesium and calcium; compounds of metals such as zinc, manganese, antimony, titanium, tin, zirconium, and germanium; phosphorous acid compounds; phosphate compounds; and amine compounds.

More specifically, usable catalysts include, but are not limited to, sodium acetate, sodium carbonate, lithium acetate, lithium carbonate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributyl antimony, tin formate, tin oxalate, tetraphenyltin, dibutyltin dichloride, dibutyltin oxide, diphenyltin oxide, zirconium tetrabutoxide, zirconium naphthenate, zirconyl carbonate, zirconyl acetate, zirconyl stearate, zirconyl octylate, germanium oxide, triphenyl phosphite, tris(2,4-di-t-butylphenyl)phosphite, ethyltriphenyl phosphonium bromide, triethylamine, and triphenylamine.

The crystalline polyester resin preferably has an acid value (i.e., the amount (mg) of KOH needed for neutralizing 1 g of a resin) of from 3.0 to 30.0 mgKOH/g, more preferably from 6.0 to 25.0 mgKOH/g, and most preferably from 8.0 to 20.0 mgKOH/g.

When the acid value falls below 3.0 mgKOH/g, the resin may get more poorly dispersible in water. It may be difficult to use such a resin for wet granulation processes. In addition, because the polymerized particles get extremely unstable at the time of aggregation, it may be difficult to effectively produce toner particles. When the acid value exceeds 30.0 mgKOH/g, the toner may get more hygroscopic and more easily influenced by environmental conditions.

The crystalline polyester resin preferably has a weight average molecular weight (Mw) of from 6,000 to 35,000. When the weight average molecular weight (Mw) is less than 6,000, the toner may penetrate into the surface of a recording medium at the time of fixing to generate uneven fixed image with poor resistance to folding. When the weight average molecular weight (Mw) exceeds 35,000, melt viscosity of the toner is so high that the toner needs to be heated to a high temperature to exhibit appropriate viscosity for fixing. This results in deterioration of low-temperature fixability.

The weight average molecular weight (Mw) can be measured by gel permeation chromatography (GPC) with an instrument HLC-8120 (from Tosoh Corporation), columns TSKgel Super HM-M (15 cm, from Tosoh Corporation), and THF solvent. The weight average molecular weight (Mw) is determined from a measurement result with reference to a molecular weight calibration curve complied from monodisperse polystyrene standard samples.

It is preferable that the resin capable of forming a crystalline structure, including the above crystalline polyester resin, consists primarily of a crystalline polyester resin obtained from an aliphatic polymerizable monomer (may be hereinafter referred to as "crystalline aliphatic polyester resin"). In other words, the resin capable of forming a crystalline structure contains the crystalline aliphatic polyester resin in an amount of 50% by weight or more. The composition ratio of the aliphatic polymerizable monomer in the crystalline aliphatic polyester resin is preferably 60% by mol or more, more preferably 90% by mol or more. As the aliphatic polymerizable monomer, the above-described aliphatic diols and dicarboxylic acids are preferred.

By controlling the kind (e.g., the length or number of hydrocarbon chains) of the aliphatic polycarboxylic acids and polyols and their quantitative ratio to aromatic polycarboxylic acids, the resulting resin A can express Tg decrease.

Resin B Incapable of Forming Crystalline Structure and Amorphous Polyester Resin B1

According to an embodiment, the toner preferably includes an amorphous polyester resin B1 as the resin B. The amorphous polyester resin B1 may be a modified polyester resin B11 or an unmodified polyester resin B12, and combination use of them is preferable.

Modified Polyester Resin B11

As the polyester resin B1, the modified polyester resin B11, described below, can be used. For example, a polyester prepolymer (B11a) having an isocyanate group can be used as the modified polyester resin B11. The polyester prepolymer (B11a) having an isocyanate group may be a reaction product of a polyester having an active hydrogen group with a polyisocyanate (3), where the polyester is a polycondensation product of a polyol (1) with a polycarboxylic acid (2). The active hydrogen group may be, for example, a hydroxyl group (e.g., an alcoholic hydroxyl group, a phenolic hydroxyl group), an amino group, a carboxyl group, or a mercapto group. Among these groups, an alcoholic hydroxyl group is most preferable.

The polyol (1) may be, for example, a diol (1-1) or a polyol (1-2) having 3 or more valences. Sole use of a diol (1-1) or a combination use of a diol (1-1) with a small amount of a polyol (1-2) having 3 or more valences is preferable. Specific examples of the diol (1-1) include, but are not limited to, alkylene glycols (e.g., ethylene glycol, 1,2-propylene glycol, 1,3-propylene glycol, 1,4-butanediol, 1,6-hexanediol); alkylene ether glycols (e.g., diethylene glycol, triethylene glycol, dipropylene glycol, polyethylene glycol, polypropylene glycol, polytetramethylene ether glycol); alicyclic diols (e.g., 1,4-cyclohexanedimethanol, hydrogenated bisphenol A); bisphenols (e.g., bisphenol A, bisphenol F, bisphenol S); alkylene oxide (e.g., ethylene oxide, propylene oxide, butylene oxide) adducts of the alicyclic diols; and alkylene oxide (e.g., ethylene oxide, propylene oxide, butylene oxide) adducts of the bisphenols. Among these compounds, alkylene glycols having 2 to 12 carbon atoms and alkylene oxide adducts of bisphenols are preferable, and combinations of alkylene oxide adducts of bisphenols with alkylene glycols having 2 to 12 carbon atoms are more preferable. Specific examples of the polyol (1-2) having 3 or more valences include, but are not limited to, polyvalent aliphatic alcohols having 3 or more valences (e.g., glycerin, trimethylolethane, trimethylolpropane, pentaerythritol, sorbitol), polyphenols having 3 or more valences (e.g., trisphenol PA, phenol novolac, cresol novolac), and alkylene oxide adducts of the polyphenols having 3 or more valences.

The polycarboxylic acid (2) may be, for example, a dicarboxylic acid (2-1) or a polycarboxylic acid (2-2) having 3 or more valences. Sole use of a dicarboxylic acid (2-1) or a combination use of a dicarboxylic acid (2-1) with a small amount of a polycarboxylic acid (2-2) having 3 or more valences is preferable. Specific examples of the dicarboxylic acid (2-1) include, but are not limited to, alkylene dicarboxylic acids (e.g., succinic acid, adipic acid, sebacic acid), alkenylene dicarboxylic acids (e.g., maleic acid, fumaric acid), and aromatic dicarboxylic acids (e.g., phthalic acid, isophthalic acid, terephthalic acid, naphthalenedicarboxylic acid). Among these compounds, alkenylene dicarboxylic acids having 4 to 20 carbon atoms and aromatic dicarboxylic acids having 8 to 20 carbon atoms are preferable. Specific examples of the polycarboxylic acid (2-2) having 3 or more valences include, but are not limited to, aromatic polycarboxylic acids having 9 to 20 carbon atoms (e.g., trimellitic acid, pyromellitic acid). Additionally, anhydrides and lower alkyl esters (e.g., methyl ester, ethyl ester, isopropyl ester) of the above-described polycarboxylic acids are also usable as the polycarboxylic acid (2).

The equivalent ratio [OH]/[COOH] of hydroxyl groups [OH] in the polyol (1) to carboxyl groups [COOH] in the polycarboxylic acid (2) is typically from 2/1 to 1/1, preferably from 1.5/1 to 1/1, and more preferably from 1.3/1 to 1.02/1.

Specific examples of the polyisocyanate (3) include, but are not limited to, aliphatic polyisocyanates (e.g., tetramethylene diisocyanate, hexamethylene diisocyanate, 2,6-diisocyanatomethyl caproate), alicyclic polyisocyanates (e.g., isophorone diisocyanate, cyclohexylmethane diisocyanate), aromatic diisocyanates (e.g., tolylene diisocyanate, diphenylmethane diisocyanate), aromatic aliphatic diisocyanates (e.g., $\alpha,\alpha,\alpha',\alpha'$-tetramethylxylylene diisocyanate), isocyanurates, and the above polyisocyanates in which the isocyanate group is blocked with a phenol derivative, an oxime, or a caprolactam. Two or more of these compounds can be used in combination.

The equivalent ratio [NCO]/[OH] of isocyanate groups [NCO] in the polyisocyanate (3) to hydroxyl groups [OH] in the polyester having a hydroxyl group is typically from 5/1 to 1/1, preferably from 4/1 to 1.2/1, and more preferably from 2.5/1 to 1.5/1. When the equivalent ratio [NCO]/[OH] exceeds 5, low-temperature fixability may decline. When the molar ratio of [NCO] is less than 1, the urea content in the modified polyester is lowered to degrade hot offset resistance. The content of the polyisocyanate (3) components in the polyester prepolymer (B11a) having an isocyanate group is typically from 0.5 to 40% by weight, preferably from 1 to 30% by weight, and more preferably from 2 to 20% by weight. When the content is less than 0.5% by weight, hot offset resistance may decline, making against achievement of a good balance between heat-resistant storage stability and low-temperature fixability. When the content exceeds 40% by weight, low-temperature fixability may decline.

The number of isocyanate groups included in one molecule of the polyester prepolymer (B11a) having an isocyanate group is typically 1 or more, preferably from 1.5 to 3 in average, and more preferably from 1.8 to 2.5 in average. When the number of isocyanate groups per molecule is less than 1, the molecular weight of the modified polyester having been cross-linked and/or elongated is lowered to degrade hot offset resistance.

Cross-Linking and Elongation Agents

Amines (Ba) can be used as cross-linking and/or elongation agents. The amine (Ba) may be, for example, a diamine (Ba-1), a polyamine (Ba-2) having 3 or more valences, an amino alcohol (Ba-3), an amino mercaptan (Ba-4), an amino acid (Ba-5), or a blocked amine (B6) in which the amino group in any of the amines (Ba-1) to (Ba-5) is blocked. Specific examples of the diamine (Ba-1) include, but are not limited to, aromatic diamines (e.g., phenylenediamine, diethyltoluenediamine, 4,4'-diaminodiphenylmethane), alicyclic diamines (e.g., 4,4'-diamino-3,3'-dimethyldicyclohexylmethane, diaminocyclohexane, isophoronediamine), and aliphatic diamines (e.g., ethylenediamine, tetramethylenediamine, hexamethylenediamine). Specific examples of the polyamine (Ba-2) having 3 or more valences include, but are not limited to, diethylenetriamine and triethylenetetramine. Specific examples of the amino alcohol (Ba-3) include, but are not limited to, ethanolamine and hydroxyethylaniline. Specific examples of the amino mercaptan (Ba-4) include, but are not limited to, aminoethyl mercaptan and aminopropyl mercaptan. Specific examples of the amino acid (Ba-5) include, but are not limited to, aminopropionic acid and aminocaproic acid.

Specific examples of the blocked amine (Ba-6) include, but are not limited to, ketimine compounds obtained from the above-described amines (Ba-1) to (Ba-5) and ketones (e.g., acetone, methyl ethyl ketone, methyl isobutyl ketone), and oxazoline compounds. Among these amines (Ba), (Ba-1) and a mixture of (Ba-1) with a small amount of (Ba-2) are preferable.

If needed, the cross-linking and/or elongation reaction may be terminated by a terminator to adjust the molecular weight of the resulting modified polyester. Specific examples of usable terminators include, but are not limited to, monoamines (e.g., diethylamine, dibutylamine, butylamine, laurylamine) and blocked monoamines (e.g., ketimine compounds).

So long as the above-described features are preserved, the resin A can include an urethane-modified resin in part or as a compositional part. In this case, modification can be performed in accordance with the above descriptions.

In the resin B, the equivalent ratio [NCO]/[NHx] of isocyanate groups [NCO] in the polyester prepolymer (B11a) having an isocyanate group to amino groups [NHx] in the amine (Ba) is typically from 1/2 to 2/1, preferably from 1.5/1 to 1/1.5, and more preferably from 1.2/1 to 1/1.2. When the equivalent ratio [NCO]/[NHx] exceeds 2 or falls below 1/2, the molecular weight of the urea-modified polyester is lowered to degrade hot offset resistance.

Unmodified Polyester Resin B12

It is preferable that the toner further includes the unmodified polyester resin (B12) in combination with the modified polyester resin (B11). Combination use of (B11) and (B12) improves low-temperature fixability, and gloss and gloss uniformity hen used in full-color apparatuses. Specific examples of (B12) include polycondensation products of the polyol (1) with the polycarboxylic acid (2), same as (B11). Preferred materials for (B12) are also same as those for (B11). Raw materials for (B12) include not only unmodified polyesters but also those modified with a chemical bond other than urea bond, for example, urethane bond. Preferably, (B11) and (B12) are at least partially compatibilized with each other in terms of low-temperature fixability and hot offset resistance. Accordingly, it is preferable that (B11) and (B12) have a similar composition. The weight ratio of (B11) to (B12) is typically from 5/95 to 75/25, preferably from 10/90 to 25/75, more preferably from 12/88 to 25/75, and most preferably from 12/88 to 22/78. When the weight ratio of (B11) is less than 5% by weight, hot offset resistance worsens, making against achievement of a good balance between heat-resistant storage stability and low-temperature fixability.

The peak molecular weight of (B12) is typically from 1,000 to 30,000, preferably from 1,500 to 10,000, and more preferably from 2,000 to 8,000. When the peak molecular weight is less than 1,000, heat-resistant storage stability worsens. When the peak molecular weight exceeds 10,000, low-temperature fixability worsens. The hydroxyl value of (B12) is preferably 5 or more, more preferably from 10 to 120, and most preferably from 20 to 80. When the hydroxyl value is less than 5, it makes against achievement of a good balance of heat-resistant storage stability and low-temperature fixability. The acid value of (B12) is typically from 0.5 to 40 and preferably from 5 to 35. Giving acid value to toner makes the toner negatively chargeable. Those with acid and hydroxyl values beyond the above-described ranges are easily influenced by environmental conditions under high-temperature and high-humidity environment and low-temperature and low-humidity environment, respectively, which leads to image deterioration.

The glass transition temperature (Tg) of the toner is typically from 40 to 70° C. and preferably from 45 to 55° C. When Tg is less than 40° C., heat-resistant storage stability worsens. When Tg exceeds 70° C., low-temperature fixability may get insufficient. Owing to coexistence of the cross-linked and/or elongated polyester resin, the toner according to an embodiment provides better storage stability compared to polyester-based toners even its Tg is low.

The temperature (TG') at which the storage elastic modulus of the toner becomes 10,000 dyne/cm$^2$ is typically 100° C. or more and preferably from 110 to 200° C., at a measuring frequency of 20 Hz. When the temperature (TG') is less than 100° C., hot offset resistance worsens. The temperature (Tη) at which the viscosity of the toner becomes 1,000 poises is typically 180° C. or less and preferably from 90 to 160° C., at a measuring frequency of 20 Hz. When the temperature (Tη) exceeds 180° C., low-temperature fixability worsens. It is preferable that TG' is higher than Tη in view of achievement of a good balance between low-temperature fixability and hot offset resistance. In other words, the difference between TG' and Tη(i.e., TG'-Tη) is preferably 0° C. or more, more preferably 10° C. or more, and most preferably 20° C. or more. There is no upper limit for the difference between TG' and Tη. It is preferable that the difference between Tη and Tg is from 0 to 100° C., more preferably from 10 to 90° C., and most preferably from 20 to 80° C., in view of achievement of a good balance between heat-resistant storage stability and low-temperature fixability.

Vinyl Resin

According to an embodiment, the toner preferably includes a vinyl resin. More preferably, the toner includes a vinyl resin in the shell part. Specific examples of usable vinyl resins include, but are not limited to, homopolymers and copolymers of vinyl monomers, such as styrene-acrylate copolymer, styrene-methacrylate copolymer, styrene-butadiene copolymer, acrylic acid-acrylate copolymer, methacrylic acid-acrylate copolymer, styrene-acrylonitrile copolymer, styrene-maleic anhydride copolymer, styrene-acrylic acid copolymer, and styrene-methacrylic acid copolymer.

Usable vinyl resins further include polymers of styrene or styrene derivatives (e.g., polystyrene, poly-p-chlorostyrene, polyvinyl toluene), styrene-based copolymers (e.g., styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymer), polymethyl methacrylate, and polybutyl methacrylate.

Colorant

Specific examples of usable colorants include, but are not limited to, carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. Two or more of these colorants can be used in combination. The content of the colorant in the toner is typically from 1 to 15% by weight and preferably from 3 to 10% by weight.

The colorant may be combined with a resin to be used as a master batch.

Specific examples of usable resins for the master batch include, but are not limited to, the above-described modified and unmodified polyester resins, polymers of styrene or styrene derivatives (e.g., polystyrene, poly-p-chlorostyrene, polyvinyl toluene), styrene-based copolymers (e.g., styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleate copolymer), polymethyl methacrylate, polybutyl methacrylate, polyvinyl chloride, polyvinyl acetate, polyethylene, polypropylene, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax. Two or more of these resins can be used in combination.

The master batch may be obtained by mixing and kneading a resin and a colorant while applying a high shearing force. To increase the interaction between the colorant and the resin, an organic solvent may be used. More specifically, the maser batch may be obtained by a method called flushing in which an aqueous paste of the colorant is mixed and kneaded with the resin and the organic solvent so that the colorant is transferred to the resin side, followed by removal of the organic solvent and moisture. This method is advantageous in that the resulting wet cake of the colorant can be used as it is without being dried. When performing the mixing or kneading, a high shearing force dispersing device such as a three roll mill may be used.

Release Agent

According to an embodiment, the toner includes a wax as a release agent. Specific examples of usable waxes include, but are not limited to, polyolefin waxes (e.g., polyethylene wax, polypropylene wax), long-chain hydrocarbons (e.g., paraffin wax, SASOL wax), and carbonyl-group-containing waxes. Among these waxes, carbonyl-group-containing waxes are preferable. Specific examples of the carbonyl-group-containing waxes include, but are not limited to, polyalkanoic acid esters (e.g., carnauba wax, montan wax, trimethylolpropane tribehenate, pentaerythritol tetrabehenate, pentaerythritol diacetate dibehenate, glycerin tribehenate, 1,18-octadecanediol distearate), polyalkanol esters (e.g., tristearyl trimellitate, distearyl maleate), polyalkanoic acid amides (e.g., ethylenediamine dibehenylamide), polyalkyl amides (e.g., trimellitic acid tristearylamide), and dialkyl ketones (e.g., distearyl ketone). Among these carbonyl-group-containing waxes, polyalkanoic acid esters are preferable. The wax preferably has a melting point of 40 to 160° C., more preferably 50 to 120° C., and most preferably 60 to 90° C. Waxes having a melting point less than 40° C. adversely affects heat-resistant storage stability. Waxes having a melting point greater than 160° C. are likely to cause cold offset in low-temperature fixing. The wax preferably has a melt viscosity of from 5 to 1,000 cps, more preferably from 10 to 100 cps, at a measuring temperature 20° C. higher than the melting point. Waxes having a melt viscosity greater than 1,000 cps are poor at improving hot offset resistance and low-temperature fixability. The content of the wax in the toner is typically from 0 to 40% by weight and preferably from 3 to 30% by weight.

Charge Controlling Agent

According to an embodiment, the toner may include a charge controlling agent. Specific examples of usable charge controlling agents include, but are not limited to, nigrosine dyes, triphenylmethane dyes, chromium-containing metal complex dyes, chelate pigments of molybdic acid, Rhodamine dyes, alkoxyamines, quaternary ammonium salts (including fluorine-modified quaternary ammonium salts), alkylamides, phosphor and phosphor-containing compounds, tungsten and tungsten-containing compounds, fluorine activators, metal salts of salicylic acid, and metal salts of salicylic acid derivatives. Specific examples of commercially available charge controlling agents include, but are not limited to, BONTRON® 03 (nigrosine dye), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complexes of quaternary ammonium salts), which are manufactured by Hodogaya Chemical Co., Ltd.; COPY CHARGE® PSY VP2038 (quaternary ammonium salt), COPY BLUER PR (triphenyl methane derivative), COPY CHARGES NEG VP2036 and COPY CHARGE® NX VP434 (quaternary ammonium salts), which are manufactured by Hoechst AG; LRA-901 and LR-147 (boron complex), which are manufactured by Japan Carlit Co., Ltd.; and copper phthalocyanine, perylene, quinacridone, azo pigments, and polymers having a functional group such as a sulfonate group, a carboxyl group, and a quaternary ammonium group.

The content of the charge controlling agent is determined according to the kind of binder resin, the presence or absence of additives optionally added, dispersing method, etc., and is not limited to a particular value, but is preferably from 0.1 to 10 parts by weight, more preferably from 0.2 to 5 parts by weight, based on 100 parts by weight of the binder resin. When the content of charge controlling agent exceeds 10 parts by weight, the toner charge is so large that the effect of the main charge controlling agent is reduced and electrostatic attracting force between a developing roller is increased. This may result in decline in developer fluidity and image density. The charge controlling agent may be first mixed with the master batch or the binder resin and then dissolved or dispersed in an organic solvent, or directly added to an organic solvent at the time of dissolving or dispersing. Alternatively, the charge controlling agent may be fixed on the surface of the resulting toner particles.

External Additive

As an external additive for supplementing fluidity, developability, and chargeability of the mother toner particles, oxide fine particles, inorganic fine particles, and/or hydrophobized inorganic fine particles can be used. It is preferable that the external additive includes at least one kind of hydrophobized inorganic fine particle having an average primary particle diameter of from 1 to 100 nm, more preferably from 5 to 70 nm. More preferably, the external additive includes at least one kind of hydrophobized inorganic fine particle having an average primary particle diameter of 20 nm or less and at least one kind of hydrophobized inorganic fine particle having an average primary particle diameter of 30 nm or more. The BET specific surface area is preferably from 2 to 500 $m^2/g$.

The external additive may include, for example, silica fine particles, hydrophobized silica, metal salts of fatty acids (e.g., zinc stearate, aluminum stearate), metal oxides (e.g., titania, alumina, tin oxide, antimony oxide), and fluoropolymers.

Fine particles of hydrophobized silica, titania, titanium oxide, and alumina are preferred as the external additive. Specific examples of commercially-available silica fine particles include, but are not limited to, HDK H 2000, HDK H 2000/4, HDK H 2050EP, HVK 21, and HDK H 1303 (from Hoechst AG); and R972, R974, RX200, RY200, R202, R805, and R812 (from Nippon Aerosil Co., Ltd.). Specific examples of commercially-available titania fine particles include, but are not limited to, P-25 (from Nippon Aerosil Co., Ltd.); STT-30 and STT-65C-S (from Titan Kogyo, Ltd.); TAF-140 (from Fuji Titanium Industry Co., Ltd.); and MT-150W, MT-500B, MT-600B, and MT-150A (from TAYCA Corporation). Specific examples of commercially available hydrophobized titanium oxide fine particles include, but are not limited to, T-805 (from Nippon Aerosil Co., Ltd.); STT-30A and STT-65S-S (from Titan Kogyo, Ltd.); TAF-500T and TAF-1500T (from Fuji Titanium Industry Co., Ltd.); MT-100S and MT-100T (from TAYCA Corporation); and IT-S (from Ishihara Sangyo Kaisha, Ltd.).

Hydrophobized fine particles of oxides, silica, titania, and alumina can be obtained by treating fine particles of oxides, silica, titania, and alumina, which are hydrophilic, with a silane coupling agent such as methyltrimethoxysilane, methyltriethoxysilane, and octyltrimethoxysilane. Additionally, silicone-oil-treated oxide fine particles and inorganic fine particles are also preferred which are treated with silicone oils upon application of heat, if needed.

Specific examples of usable silicone oils include, but are not limited to, dimethyl silicone oil, methyl phenyl silicone oil, chlorophenyl silicone oil, methyl hydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, acrylic-modified or methacrylic-modified silicone oil, and α-methylstyrene-modified silicone oil.

Specific examples of usable inorganic fine particles include, but are not limited to, silica, alumina, titanium oxide, barium titanate, magnesium titanate, calcium titanate, strontium titanate, iron oxide, copper oxide, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Among these materials, silica and titanium dioxide are preferable. The content of the external additive in the toner is typically from 0.1 to 5% by weight and preferably from 0.3 to 3% by weight. The average primary particle diameter of the inorganic fine particle is typically 100 nm or less and preferably from 3 to 70 nm. When the average primary particle diameter falls below the above-described range, the inorganic fine particle will be embedded in the toner and its functions cannot be effectively exhibited. When the average primary particle diameter exceeds the above-described range, the inorganic fine particle will damage the surface of photoreceptor unevenly.

Additionally, fine particles of polymers (e.g., polystyrene, copolymers of methacrylates or acrylates) obtainable by soap-free emulsion polymerization, suspension polymerization, or dispersion polymerization; polycondensation polymers (e.g., silicone, benzoguanamine, nylon); and thermosetting resins are also usable as the external additive.

The external additive may be surface-treated to improve its hydrophobicity to prevent deterioration of fluidity and chargeability even under high-humidity conditions. Specific examples of usable surface treatment agents include, but are not limited to, silane coupling agents, silylation agents, silane coupling agents having a fluorinated alkyl group, organic titanate coupling agents, aluminum coupling agents, silicone oils, and modified silicone oils.

As a cleanability improving agent for improving removability from photoreceptor or primary transfer medium when remaining thereon after image transfer, for example, metal salts of fatty acids (e.g., zinc stearate, calcium stearate) and polymer fine particles prepared by soap-free emulsion polymerization (e.g., polymethyl methacrylate fine particles, polystyrene fine particles) can be used. Polymer fine particles having a relatively narrow particle size distribution and a volume average particle diameter of from 0.01 to 1 μm are preferred.

Resin Fine Particle

According to an embodiment, the mother toner particle further includes resin fine particles. The resin fine particles preferably have a glass transition temperature (Tg) of from 40 to 100° C. and a weight average molecular weight of from 3,000 to 300,000. When the glass transition temperature (Tg) is less than 40° C. and/or the weight average molecular weight is less than 3,000, storage stability of the toner worsens to cause toner blocking when the toner is stored or being in developing device. When the glass transition temperature (Tg) exceeds 100° C. and/or the weight average molecular weight exceeds 300,000, the resin fine particles are inhibited from adhering to paper, resulting in increase in the lower limit of fixable temperature.

The content rate of the resin fine particles in the toner is preferably from 0.5 to 5.0% by weight. When the content rate is less than 0.5% by weight, storage stability of the toner worsens to cause toner blocking when the toner is stored or being in developing device. When the content rate exceeds 5.0% by weight, the resin fine particles inhibit the wax from exuding and the wax cannot exert its releasing effect, causing offset.

The content rate of the resin fine particles can be determined by detecting a substance attributable to the resin fine particles but not attributable to the mother toner particles with a pyrolysis gas chromatography mass spectrometer and quantifying the peak area corresponding to the substance. The mass spectrometer is a preferable detector, but there is no limit in choosing the detector.

Every resins capable of forming their aqueous dispersion can be used as the resin fine particles, including thermoplastic resins and thermosetting resins. Specific examples of usable resins include, but are not limited to, vinyl resin, polylactic resin, polyurethane resin, epoxy resin, polyester resin, polyamide resin, polyimide resin, silicone resin, phenol resin, melamine resin, urea resin, aniline resin, ionomer resin, and polycarbonate resin. Two or more of these resins can be used in combination. Among these resins, vinyl resin, polyurethane resin, epoxy resin, polyester resin, and combinations thereof are preferable because aqueous dispersions of fine spherical particles thereof are easily obtainable.

Specific examples of usable vinyl resins include, but are not limited to, homopolymers and copolymers of vinyl monomers, such as styrene-acrylate copolymer, styrene-methacrylate copolymer, styrene-butadiene copolymer, acrylic acid-acrylate copolymer, methacrylic acid-acrylate copolymer, styrene-acrylonitrile copolymer, styrene-maleic anhydride copolymer, styrene-acrylic acid copolymer, and styrene-methacrylic acid copolymer.

Manufacturing Method

Binder resins for the toner can be manufactured as follows. First, heat a polyol (1) and a polycarboxylic acid (2) to between 150 and 280° C. in the presence of an esterification catalyst (e.g., tetrabutoxy titanate, dibutyltin oxide) while reducing pressure and removing by-product water, if necessary, to obtain a polyester having a hydroxyl group. Next, allow the polyester having a hydroxyl group to react with a polyisocyanate (3) to obtain a prepolymer (B11-p) having an isocyanate group.

In accordance with some embodiments, the toner can be prepared as follows.

Toner Manufacturing Method in Aqueous Medium

An aqueous phase to which the resin fine particles are previously added is preferably used. The resin fine particles function as particle diameter controllers and are allocated on the periphery of each mother toner particle, forming a shell layer that covers the surface of the mother toner particle. To impart sufficient functions to the shell layer, careful control of the particle diameter and composition of the resin fine particles, the dispersants (surfactants) and solvents present in the aqueous phase, etc., is required because they have effect on the functions of the shell layer.

The aqueous phase may consist of water alone or a combination of water with a water-miscible solvent. Specific examples of usable water-miscible solvents include, but are not limited to, alcohols (e.g., methanol, isopropanol, ethylene glycol), dimethylformamide, tetrahydrofuran, cellosolves (e.g., methyl cellosolve), and lower ketones (e.g., acetone, methyl ethyl ketone).

Toner particles can be obtained by dissolving or dispersing the polyester prepolymer (B11-p) having an isocyanate group in an organic solvent and disperse it in the aqueous phase while allowing it to react with the amine (Ba). A method of stably dispersing the polyester prepolymer (B11-p) in the aqueous phase may include, for example, dissolving or dispersing toner raw materials including the polyester prepolymer (B11-p) having an isocyanate group in an organic solvent and disperse it in the aqueous phase by application of shearing force. The polyester prepolymer (B11-p) having been dissolved or dispersed in an organic solvent may be mixed with an oily phase that contains other toner raw materials, such as a colorant, a colorant master batch, a release agent, a charge controlling agent, and an unmodified polyester resin, at the time they are dispersed in the aqueous phase. More preferably, a mixture of toner raw materials may be dissolved or dispersed in the organic solvent in advance and then the resulting mixture (oily phase) is dispersed in the aqueous phase. Alternatively, the toner raw materials, such as a colorant, a release agent, and a charge controlling agent, are not necessarily included in the organic phase at the time of granulation in the aqueous phase and may be added to toner particles after the granulation. For example, it is possible to prepare particles including no colorant and then dye the particles with a colorant in a later process.

Specific examples of dispersing methods include, but are not limited to, methods using any of the following: low-speed shearing type, high-speed shearing type, frictional type, high-pressure jet type, and ultrasonic type. To adjust the particle diameter of the dispersing elements to 2 to 20 μm, a high-speed shearing type disperser is preferable. When a high-speed shearing type disperser is used, the revolution is typically from 1,000 to 30,000 rpm and preferably from 5,000 to 20,000 rpm. The dispersing time for a batch type disperser is typically from 0.1 to 5 minutes, but is not limited thereto. The dispersing temperature is typically from 0 to 150° C. (under pressure) and preferably from 40 to 98° C. The higher the temperature, the lower the viscosity of the dispersion of the polyester prepolymer (B11-p). Thus, the higher temperatures are preferable in terms of the ease of dispersion.

The used amount of the aqueous phase is typically from 50 to 2,000 parts by weight and preferably from 100 to 1,000 parts by weight, based on 100 parts by weight of toner composition including the polyester prepolymer (B11-p). When the used amount is less than 50 parts by weight, the dispersed state of the toner composition is poor and toner particles having a desired particle size cannot be obtained. When the used amount exceeds 20,000 parts by weight, it is not economical. As necessary, dispersants can be used. Use of dispersants is preferable because the particle size distribution is narrowed and the dispersion becomes stable.

Specific examples of dispersants for emulsifying or dispersing an oily phase, in which toner composition is dispersed, in an aqueous phase include, but are not limited to, anionic surfactants such as alkylbenzene sulfonate, α-olefin sulfonate, and phosphates; cationic surfactants such as amine salt type surfactants (e.g., alkylamine salts, amino alcohol fatty acid derivatives, polyamine fatty acid derivatives, imidazoline) and quaternary ammonium salt type surfactants (e.g., alkyl trimethyl ammonium salt, dialkyl dimethyl ammonium salt, alkyl dimethyl benzyl ammonium salt, pyridinium salt, alkyl isoquinolinium salt, and benzethonium chloride); nonionic surfactants such as fatty acid amide derivatives and polyvalent alcohol derivatives; and ampholytic surfactants such as alanine, dodecyldi(aminoethyl) glycine, di(octylaminoethyl) glycine, and N-alkyl-N, N-dimethyl ammonium betaine.

Surfactants having a fluoroalkyl group can achieve an effect in small amounts. Specific preferred examples of usable anionic surfactants having a fluoroalkyl group include, but are not limited to, fluoroalkyl carboxylic acids having 2 to 10 carbon atoms and metal salts thereof, perfluorooctane sulfonyl glutamic acid disodium, 3-[ω-fluoroalkyl(C6-C11)oxy]-1-alkyl(C3-C4) sulfonic acid sodium, 3-[ω-fluoroalkanoyl(C6-C8)-N-ethylamino]-1-propane sulfonic acid sodium, fluoroalkyl(C11-C20) carboxylic acids and metal salts thereof, perfluoroalkyl(C7-C13) carboxylic acids and metal salts thereof, perfluoroalkyl(C4-C12) sulfonic acids and metal salts thereof, perfluorooctane sulfonic acid diethanol amide, N-propyl-N-(2-hydroxyethyl) perfluorooctane sulfonamide, perfluoroalkyl(C6-C10) sulfonamide propyl trimethyl ammonium salts, perfluoroalkyl(C6-C10)-N-ethyl sulfonyl glycine salts, and monoperfluoroalkyl(C6-C16) ethyl phosphates.

Specific examples of commercially available anionic surfactants having a fluoroalkyl group include, but are not limited to, SURFLON® S-111, S-112, and S-113 (from AGC Seimi Chemical Co., Ltd.); FLUORAD FC-93, FC-95, FC-98, and FC-129 (from Sumitomo 3M); UNIDYNE DS-101 and DS-102 (from Daikin Industries, Ltd.); MEGAFACE F-110, F-120, F-113, F-191, F-812, and F-833 (from DIC Corporation); EFTOP EF-102, 103, 104, 105, 112, 123A, 123B, 306A, 501, 201, and 204 (from Mitsubishi Materials Electronic Chemicals Co., Ltd.); and FTERGENT F-100 and F-150 (from Neos Company Limited).

Specific examples of usable cationic surfactants include, but are not limited to, aliphatic primary and secondary amine acids having a fluoroalkyl group; aliphatic quaternary ammonium salts such as perfluoroalkyl(C6-C10) sulfonamide propyl trimethyl ammonium salts; benzalkonium salts; benzethonium chlorides; pyridinium salts; and imidazolinium salts. Specific examples of commercially available cationic surfactants having a fluoroalkyl group include, but are not limited to, SURFLON® S-121 (from AGC Seimi Chemical Co., Ltd.); FLUORAD FC-135 (from Sumitomo 3M); UNIDYNE DS-202 (from Daikin Industries, Ltd.); MEGAFACE F-150 and F-824 (from DIC Corporation); EFTOP EF-132 (from Mitsubishi Materials Electronic Chemicals Co., Ltd.); and FTERGENT F-300 (from Neos Company Limited).

Poorly-water-soluble inorganic compounds such as tricalcium phosphate, calcium carbonate, titanium oxide, colloidal silica, and hydroxyapatite are also usable as the dispersant.

Additionally, polymeric protection colloids are also usable to stabilize dispersing liquid droplets. Specific examples of usable polymeric protection colloids include, but are not limited to, homopolymers and copolymers obtained from monomers, such as acids (e.g., acrylic acid, methacrylic acid, α-cyanoacrylic acid, α-cyanomethacrylic acid, itaconic acid, crotonic acid, fumaric acid, maleic acid, maleic anhydride), hydroxyl-group-containing acrylates and methacrylates (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate, glycerin monomethacrylate), vinyl alcohols and vinyl alcohol ethers (e.g., vinyl methyl ether, vinyl ethyl ether, vinyl propyl ether), esters of vinyl alcohols with carboxyl-group-containing compounds (e.g., vinyl acetate, vinyl propionate, vinyl butyrate), amides (e.g., acrylamide, methacrylamide, diacetone acrylamide) and methylol compounds thereof (e.g., N-methylol acrylamide, N-methylol methacrylamide), acid chlorides (e.g., acrylic acid chloride, methacrylic acid chloride), and monomers containing nitrogen or a nitrogen-containing heterocyclic ring (e.g., vinyl pyridine, vinyl pyrrolidone, vinyl imidazole, ethylene imine); polyoxyethylenes (e.g., polyoxyethylene, polyoxypropylene, polyoxyethylene alkylamine, polyoxypropylene alkylamine, polyoxyethylene alkylamide, polyoxypropylene alkylamide, polyoxyethylene nonyl phenyl ether, polyoxyethylene lauryl phenyl ether, polyoxyethylene stearyl phenyl ester, polyoxyethylene nonyl phenyl ester); and celluloses (e.g., methyl cellulose, hydroxyethyl cellulose, hydroxypropyl cellulose).

In a case in which an acid-soluble or base-soluble substance, such as calcium phosphate, is used as a dispersion stabilizer, the resulting particles may be first washed with an acid (e.g., hydrochloric acid) to dissolve the dispersion stabilizer and then water to wash it away. Alternatively, such a dispersion stabilizer can be removed by being decomposed by an enzyme.

The dispersant may keep remaining on the surface of the toner particle. Preferably, in terms of chargeability, the dispersant is washed away from the surface of the toner particle after termination of the elongation and/or cross-linking reaction.

The elongation and/or cross-linking reaction time is determined depending on the reactivity between the prepolymer (B11-p) and the amine (Ba), varying according to the structure of the isocyanate group in the prepolymer (B11-p), and is typically from 10 minutes to 40 hours and preferably from 2 to 24 hours. The reaction temperature is typically from 0 to 150° C. and preferably from 40 to 98° C. As necessary, catalysts can be used. Specific examples of usable catalysts include, but are not limited to, dibutyltin laurate and dioctyltin laurate.

To remove the organic solvent from the resulting emulsion, it is possible that the emulsion is gradually heated so that the organic solvent is completely evaporated from the liquid droplets in the emulsion. Alternatively, it is also possible that the emulsion is sprayed into dry atmosphere so that non-aqueous organic solvents are removed from the liquid droplets as much as possible to form toner particles while aqueous dispersants are evaporated therefrom. The dry atmosphere into which the emulsion is sprayed may be, for example, heated gaseous matter of air, nitrogen, carbon dioxide gas, or combustion gas, and especially those heated to above the maximum boiling point among the used solvents. Such a treatment can be reliably performed by a spray drier, a belt drier, or a rotary kiln, within a short period of time.

It is also possible that the organic solvent is removed by flowing air using a rotary evaporator.

The emulsion is then repeatedly subjected to a set of processes including crude separation by means of centrifugal separation, washing in a tank, and drying by a hot air dryer, to obtain mother toner particles.

Preferably, the mother toner particles are then subjected to an aging (annealing) process. The aging temperature is preferably from 30 to 55° C. and more preferably from 40 to 50° C., and the aging time is preferably from 5 to 36 hours and more preferably from 10 to 24 hours.

This process is one of beneficial processes for achieving desired dispersion size and shape (i.e., the lengths of long and short axes and the aspect ratio) of the resin A. Further, this process has a role to reorder the crystal size disturbed by re-agitation dispersion of the oily phase after gradual cooling. Moreover, in a case in which particle size distribution is wide at the time of emulsification and the wide particle size distribution is kept throughout succeeding washing and drying processes, the particles can be classified in this process to achieve a desired particle size distribution.

In classification treatment, ultrafine particles can be removed by means of cyclone separation, decantation, or centrifugal separation in liquids. Although the classification treatment can be performed after the particles are dried into powder, it is preferably performed in liquids in terms of efficiency. The collected unneeded ultrafine and coarse particles, either in dry or wet condition, can be reused for preparation of toner particles.

It is preferable that the dispersant is removed from the dispersion as much as possible, more preferably, at the time of the classification treatment.

The dried mother toner particles may be mixed with heterogeneous particles of release agent, charge controlling agent, fluidizer, colorant, etc. Mechanical impulsive force may be imparted to the mixed powder so that the heterogeneous particles are fixed or fused on the surfaces of the mother toner particles and are prevented from releasing therefrom.

Methods of imparting mechanical impulsive force include, for example, agitating the mixed powder with blades rotating at a high speed, and accelerating the mixed powder in a high-speed airflow to allow the mother toner particles and heterogeneous particles collide with a collision plate. Such a treatment can be performed by ONG MILL (from Hosokawa Micron Co., Ltd.), a modified I-TYPE MILL in which the pulverizing air pressure is reduced (from Nippon Pneumatic Mfg. Co., Ltd.), HYBRIDIZATION SYSTEM (from Nara Machine Co., Ltd.), KRYPTON SYSTEM (from Kawasaki Heavy Industries, Ltd.), or an automatic mortar.

Finally, the mother toner particles are mixed with an external additive (e.g., inorganic fine particles) by a mixer (e.g., HENSCHEL MIXER) and coarse particles are removed therefrom by ultrasonic sieving. Thus, a toner is obtained.

Solvent in Oily Phase

As the organic solvent to be included in the oily phase, ethyl acetate is preferable. In addition to water-insoluble and water-poorly-soluble solvents such as methyl acetate, toluene, hexane, tetrachloroethylene, chloroform, diethyl ether, methylene chloride, and benzene, hydrophilic organic solvents capable of dissolving or dispersing resin, colorant, etc., can also be used such as THF (tetrahydrofuran), acetone, methanol, ethanol, propanol, butanol, isopropyl alcohol, dimethylsulfoxide, acetonitrile, acetic acid, formic acid, N,N-dimethylformamide, and methyl ethyl ketone.

Carrier for Two-component Developer

According to an embodiment, a two-component developer is provided by mixing the above-described toner with a magnetic carrier. The content ratio of the toner to the carrier in the developer is preferably from 1 to 10 parts by weight based on 100 parts by weight of the carrier. The magnetic carrier may be comprised of, for example, iron powder, ferrite powder, magnetite powder, or magnetic resin particles, having a particle diameter about 20 to 200 μm. Specific examples of usable covering materials for the magnetic carrier include, but are not limited to, amino resins (e.g., urea-formaldehyde resin, melamine resin, benzoguanamine resin, urea resin, polyamide resin, epoxy resin), polyvinyl and polyvinylidene resins (e.g., acrylic resin, polymethyl methacrylate resin, polyacrylonitrile resin, polyvinyl acetate resin, polyvinyl alcohol resin, polyvinyl butyral resin), styrene resins (e.g., polystyrene resin, styrene-acrylic copolymer resin), halogenated olefin resins (e.g., polyvinyl chloride), polyester resins (e.g., polyethylene terephthalate, polybutylene terephthalate), polycarbonate resins, polyethylene resins, polyvinyl fluoride resins, polyvinylidene fluoride resins, poly(trifluoroethylene) resins, poly(hexafluoropropylene) resins, vinylidene fluoride-acrylic copolymer, vinylidene fluoride-vinyl fluoride copolymer, tetrafluoroethylene-vinylidene fluoride-non-fluoride monomer terpolymer, and silicone resins. The covering material may contain a conductive powder therein, if necessary. Specific examples of usable conductive powders include, but are not limited to, metal, carbon black, titanium oxide, tin oxide, and zinc oxide. Preferably, the conductive powder has an average particle diameter of 1 μm or less. When the average particle diameter is greater than 1 μm, it may be difficult to control electric resistivity.

The toner according to an embodiment can also be used as a magnetic or non-magnetic one-component developer using no carrier.

Tandem-Type Full-Color Image Forming Apparatus

Figure 3:
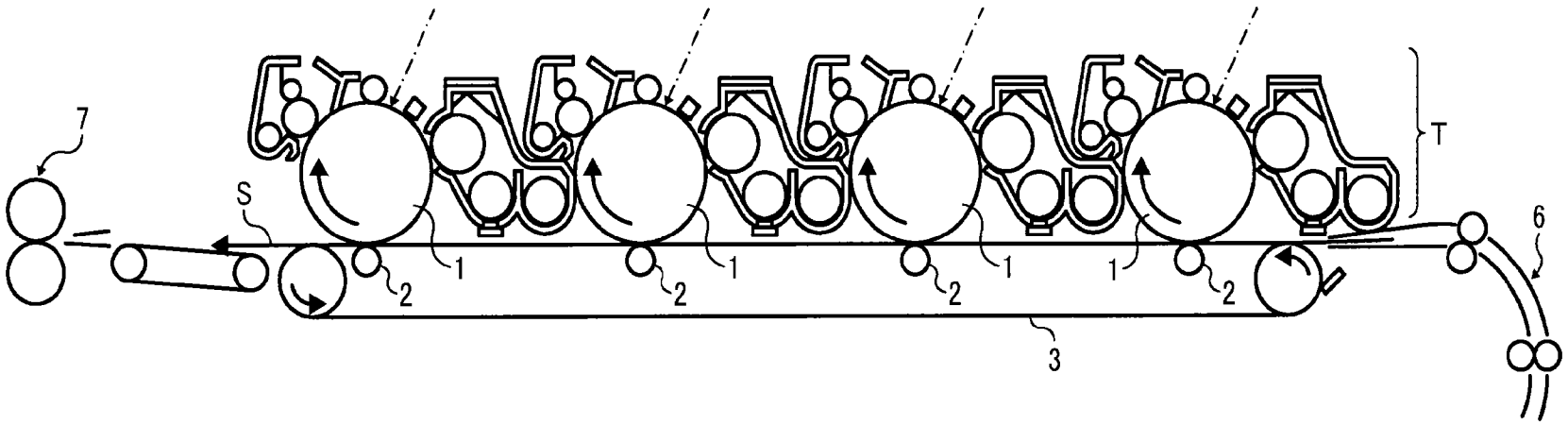
FIG. 3 is a schematic view of an image forming apparatus according to an embodiment.
Figure 4:
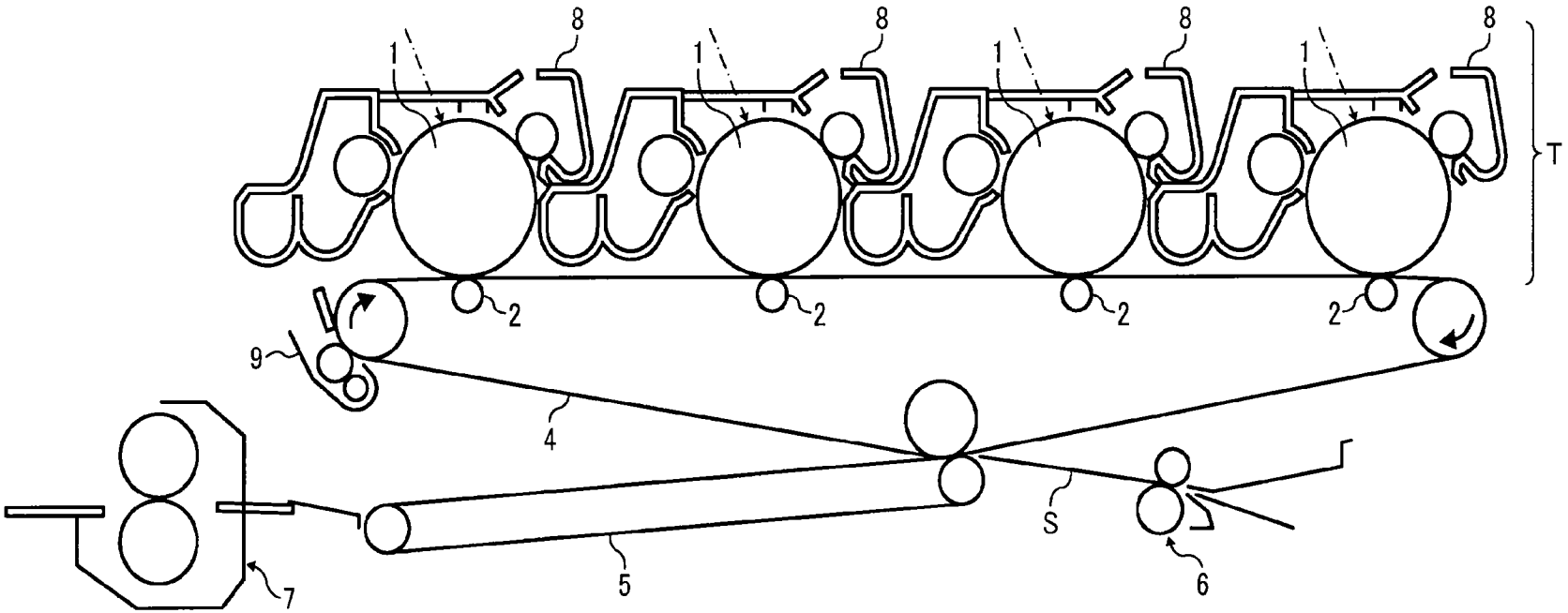
FIG. 4 is a schematic view of another image forming apparatus according to an embodiment.

According to an embodiment, a full-color image forming apparatus is provided which employs a tandem-type developing device including at least four developing units arranged in tandem each having a different developing color. Examples of such a tandem-type full-color image forming apparatus are described below. FIG. 3 is a schematic view of a tandem-type electrophotographic apparatus employing a direct transfer method. Image on each photoreceptor 1 is sequentially transferred by each transfer device 2 onto a sheet S conveyed by a sheet conveyance belt 3. FIG. 4 is a schematic view of a tandem-type electrophotographic apparatus employing an indirect transfer method. Image on each photoreceptor 1 is sequentially transferred by each primary transfer device 2 onto an intermediate transfer member 4 and then the transferred images on the intermediate transfer member 4 are transferred at once by a secondary transfer device 5 onto a sheet S. The secondary transfer device 5 illustrated in FIG. 4 is in the form of a transfer conveyance belt, but may take the form of a roller.

In comparing the direct and indirect transfer methods, the former is disadvantageous in terms of size because a paper feeder 6 and a fixing device 7 should be respectively allocated upstream and downstream from the tandem-type image forming unit T in which the photoreceptors 1 are arranged in tandem, making the apparatus larger in the direction of conveyance of sheet.

By contrast, in the latter, the secondary transfer position can be allocated relatively freely.

Therefore, the paper feeder 6 and the fixing device 7 can be allocated overlapping the tandem-type image forming unit T, advantageously making the apparatus more compact.

In the former, not to make the apparatus larger in the direction of conveyance of sheet, the fixing device 7 should be allocated adjacent to the tandem-type image forming unit T. This does not permit the fixing device 7 be allocated with a wide marginal space wherein the sheet S can sag. Thus, the fixing device 7 will make negative impacts on the image forming processes at the upstream side due to an impact of the leading edge of the sheet S entering into the fixing device 7 (notable when the sheet is thick) and the difference in sheet conveyance speed between the fixing device 7 and the transfer conveyance belt.

In the latter, on the other hand, the fixing device 7 can be allocated with a wide marginal space wherein the sheet S can sag. Thus, the fixing device 7 will not make negative impacts on the image forming processes at the upstream side.

In view of this, tandem-type electrophotographic apparatuses employing an indirect transfer method have been receiving attention recently.

In such an electrophotographic apparatus, as shown in FIG. 4, residual toner particles remaining on the photoreceptor 1 after the primary transfer are removed by a photoreceptor cleaner 8 so that the surface of the photoreceptor 1 is cleaned to prepare for a next image formation. Residual toner particles remaining on the intermediate transfer member 4 after the secondary transfer are removed by an intermediate transfer member cleaner 9 so that the surface of the intermediate transfer member 4 is cleaned to prepare for a next image formation.

Figure 5:
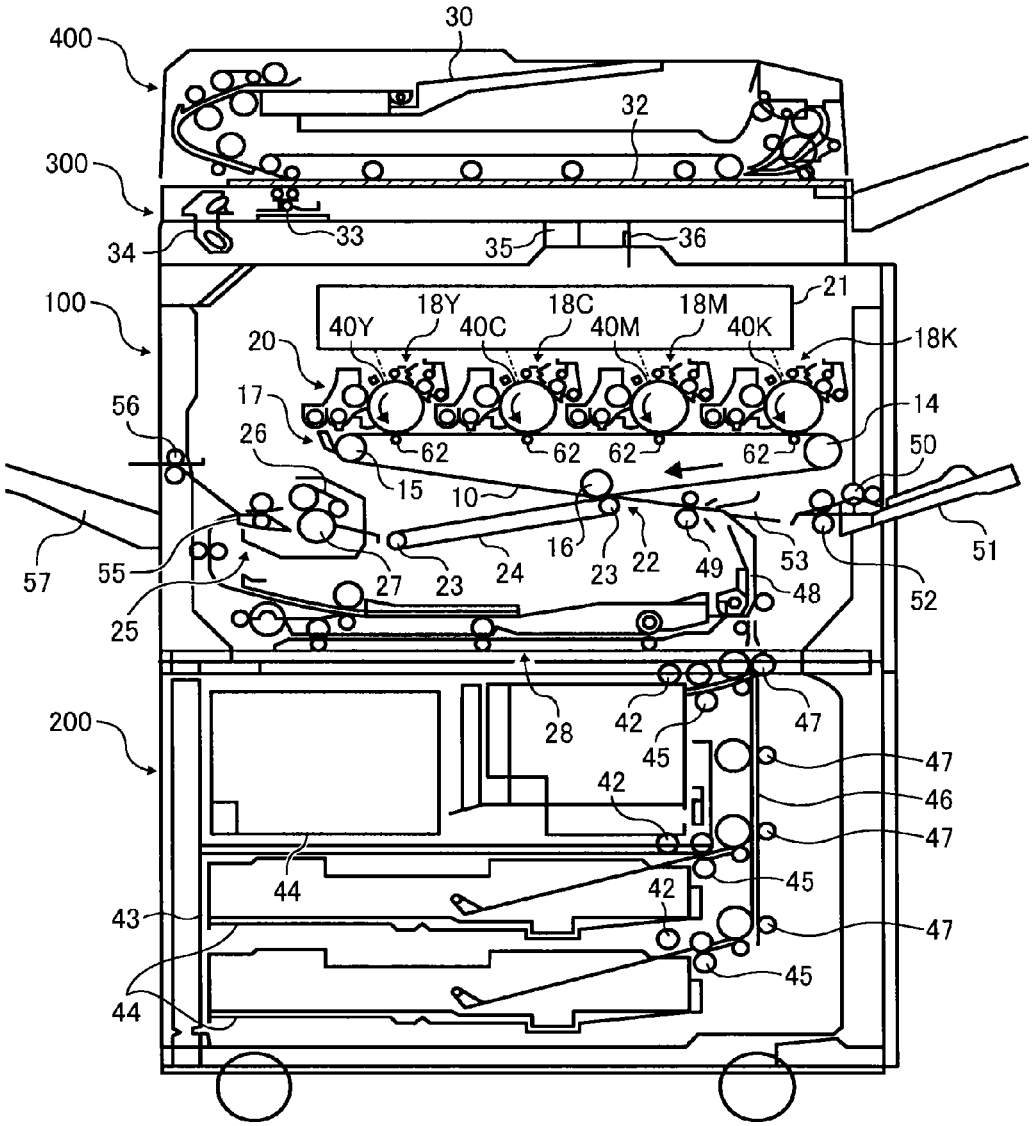
FIG. 5 is a schematic view of a tandem-type electrophotographic apparatus according to an embodiment employing an indirect transfer method.

FIG. 5 is a schematic view of another tandem-type electrophotographic apparatus employing an indirect transfer method according to an embodiment. The image forming apparatus includes a main body 100, a paper feed table 200 on which the main body 100 put, a scanner 300 attached on the main body 100, and an automatic document feeder (ADF) 400 attached on the scanner 300. An intermediate transfer member 10 in the form of a seamless belt is disposed at the center of the main body 100.

The intermediate transfer member 10 is stretched across three support rollers 14, 15, and 16 to be rotatable clockwise in FIG. 5.

An intermediate transfer member cleaner 17 is disposed on the left side of the second support roller 15 in FIG. 5 to remove residual toner particles remaining on the intermediate transfer member 10 after image transfer.

Image forming units 18Y, 18C, 18M, and 18K to produce respective images of yellow, cyan, magenta, and black are arranged in tandem along a stretched surface of the intermediate transfer member 10 between the first and second support rollers 14 and 15, constituting a tandem image forming part 20.

An irradiator 21 is disposed immediately above the tandem image forming part 20 as shown in FIG. 5. A secondary transfer device 22 is disposed on the opposite side of the tandem image forming part 20 relative to the intermediate transfer member 10. The secondary transfer device 22 consists of a secondary transfer belt 24 in the form of a seamless belt stretched between two rollers 23. The secondary transfer device 22 is allocated so that the secondary transfer belt 24 is pressed against the third support roller 16 with the intermediate transfer member 10 therebetween. The secondary transfer device 22 is configured to transfer image from the intermediate transfer member 10 onto a sheet of recording medium.

A fixing device 25 to fix toner image on the sheet is disposed adjacent to the secondary transfer device 22. The fixing device 25 consists of a fixing belt 26 in the form of a seamless belt and a pressing roller 27 pressed against the fixing belt 26.

The secondary transfer device 22 has another function of conveying sheets having toner image thereon to the fixing device 25. A transfer roller or a non-contact charger may be used as the secondary transfer device 22, it is difficult for them to have the function of conveying sheets.

A sheet reversing device 28 is disposed below the secondary transfer device 22 and the fixing device 25 and in parallel with the tandem image forming part 20. The sheet reversing device 28 is configured to reverse a sheet upside down so that images can be recorded on both sides of the sheet.

To make a copy, a document is set on a document table 30 of the automatic document feeder 400. Alternatively, a document is set on a contact glass 32 of the scanner 300 while the automatic document feeder 400 is lifted up, followed by holding down of the automatic document feeder 400.

As a switch is pressed, in a case in which a document is set on the contact glass 32, the scanner 300 immediately starts driving to run a first runner 32 and a second runner 34. In a case in which a document is set on the automatic document feeder 400, the scanner 300 starts driving after the document is fed onto the contact glass 32. The first runner 33 directs light from a light source to the document and reflects a light reflected from the document toward the second runner 34. A mirror in the second runner 34 reflects the light toward a reading sensor 36 through an imaging lens 35. Thus, the document is read.

On the other hand, as the switch is pressed, one of the support rollers 14, 15, and 16 is driven to rotate by a driving motor and the other two support rollers are driven to rotate by rotation of the rotating support roller. Thus, the intermediate transfer member 10 is rotatably conveyed. At the same time, in the image forming units 18Y, 18C, 18M, and 18K, single-color toner images of yellow, magenta, cyan, and black are formed on photoreceptors 40Y, 40C, 40M, and 40K, respectively. The single-color toner images are sequentially transferred onto the intermediate transfer member 10 as the intermediate transfer member 10 is conveyed. As a result, a composite full-color toner image is formed thereon.

On the other hand, as the switch is pressed, one of paper feed rollers 42 starts rotating in the paper feed table 200 to feed sheets of recording paper from one of paper feed cassettes 44 in a paper bank 43. One of separation rollers 45 separates the sheets one by one and feeds them to a paper feed path 46. Feed rollers 47 feed each sheet to a paper feed path 48 in the main body 100. The sheet is stopped by striking a registration roller 49.

Alternatively, a feed roller 51 starts rotating to feed sheets from a manual feed tray 50. A separation roller 52 separates the sheets one by one and feeds them to a manual paper feed path 53. The sheet is stopped by striking the registration roller 49.

The registration roller 49 starts rotating to feed the sheet to between the intermediate transfer member 10 and the secondary transfer device 22 in synchronization with an entry of the composite full-color toner image formed on the intermediate transfer member 10 thereto. The secondary transfer device 22 then transfers the composite full-color toner image onto the sheet.

The secondary transfer device 22 then feeds the sheet to the fixing device 25. In the fixing device 25, the transferred toner image is fixed on the sheet by application of heat and pressure. A switch claw 55 switches paper feed paths so that the sheet is discharged by a discharge roller 56 onto a discharge tray 57. Alternatively, the switch claw 55 may switch paper feed paths so that the sheet is introduced into the sheet reversing device 28. In the sheet reversing device 28, the sheet gets reversed and is introduced to the transfer position again to record another image on the back side of the sheet. Thereafter, the sheet is discharged by the discharge roller 56 onto the discharge tray 57.

On the other hand, the intermediate transfer member cleaner 17 removes residual toner particles remaining on the intermediate transfer member 10 after image transfer. Thus, the tandem image forming part 20 gets ready for a next image formation.

The registration roller 49 is generally grounded. Alternatively, it is possible that the registration roller 49 is applied with a bias for the purpose of removing paper powders from the sheet.

Figure 6:
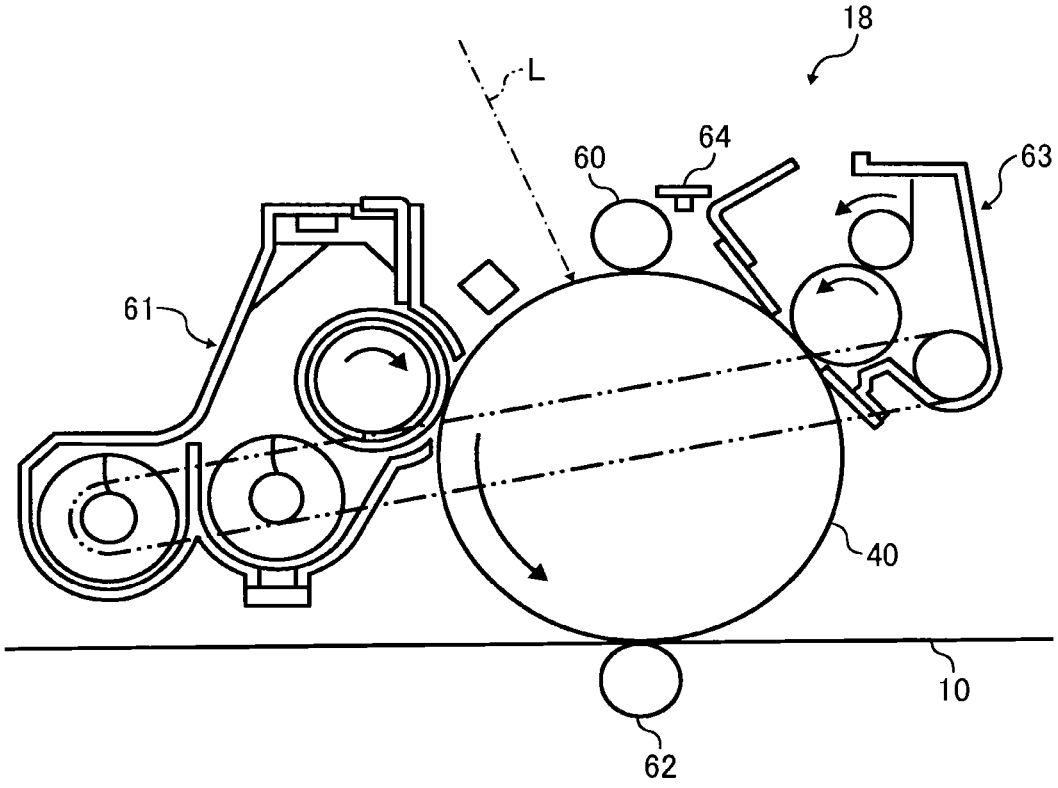
FIG. 6 is a schematic view of each image forming unit in the tandem-type electrophotographic apparatus illustrated in FIG. 5.

FIG. 6 is a magnified schematic view of one of the image forming units 18 in the tandem image forming part 20. The image forming unit 18 includes a photoreceptor 40; and a charger 60, a developing device 61, a primary transfer device 62, a photoreceptor cleaner 63, and a neutralizer 64, disposed around the photoreceptor 40.

EXAMPLES

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Test Machine A

As a test machine A, a modified image forming apparatus IMAGIO MPC6000 (from Ricoh Co., Ltd.) is used in which the fixing part has been modified. The linear speed is adjusted to 350 mm/sec. In the fixing unit, the fixing surface pressure and fixing nip time are adjusted to 40 N/cm$^2$ and 40 ms, respectively. The surface of the fixing medium is formed of a tetrafluoroethylene-perfluoroalkyl vinyl ether copolymer resin (PFA) through the processes of application, shape forming, and surface conditioning. The heating temperature of the fixing unit is adjusted to 100° C.

Evaluation of Two-Component Developer

Two-component developers are prepared for image evaluation by uniformly mixing 100 parts by weight of a ferrite carrier, having a silicone resin coating with an average thickness of 0.5 μm and an average particle diameter of 35 μm, with 7 parts of each toner with a TURBULA MIXER that causes agitation by rolling motion. The ferrite carrier is prepared as follows.

| Preparation of Carrier | |
|---|---|
| Core material (Mn ferrite particle having a weight average particle diameter of 35 μm) | 5,000 parts |

| Coating materials | |
|---|---|
| Toluene | 450 parts |
| Silicone resin (SR2400 from Dow Corning Toray Co., Ltd., including 50% of non-volatile contents) | 450 parts |
| Aminosilane (SH6020 from Dow Corning Toray Co., Ltd.) | 10 parts |
| Carbon black | 10 parts |

The above coating materials are subjected to a dispersion treatment with a stirrer for 10 minutes to prepare a coating liquid. The coating liquid and the core material are put into a coating machine, which contains a fluidized bed equipped with a rotary bottom disc and agitation blades configured to generate swirling flow, to apply the coating liquid to the core material. The core material having been applied with the coating liquid is burnt in an electric furnace at 250° C. for 2 hours. Thus, a carrier is prepared.

Example 1

Manufacture Example 1

Preparation of Resin Particle Emulsion

A reaction vessel equipped with a stirrer and a thermometer is charged with 683 parts of water, 11 parts of a sodium salt of a sulfate of ethylene oxide adduct of methacrylic acid (ELEMINOL RS-30 from Sanyo Chemical Industries, Ltd.), 20 parts of a polylactic acid, 50 parts of styrene, 100 parts of methacrylic acid, 80 parts of butyl acrylate, and 1 part of ammonium persulfate. The mixture is agitated at a revolution of 3,800 rpm for 30 minutes, thus preparing a white emulsion. The white emulsion is heated to 75° C. and subjected to a reaction for 4 hours. Further, 30 parts of 1% aqueous solution of ammonium persulfate are added to the emulsion and the mixture is aged at 65° C. for 7 hours. Thus, a resin particle dispersion 1 that is an aqueous dispersion of a vinyl resin (i.e., a copolymer of styrene, methacrylic acid, butyl acrylate, and a sodium salt of a sulfate of ethylene oxide adduct of methacrylic acid) is prepared. The volume average particle diameter measured by an instrument LA-920 of the resin particle dispersion 1 is 230 nm. A part of the resin particle dispersion 1 is dried to isolate the resin component. The isolated resin component has a Tg of 58° C. and a weight average molecular weight of 40,000.

Manufacture Example 2

Preparation of Aqueous Phase

An aqueous phase 1 is prepared by mixing 990 parts of water, 83 parts of the resin particle dispersion 1, 37 parts of a 48.3% aqueous solution of dodecyl diphenyl ether sodium disulfonate (ELEMINOL MON-7 from Sanyo Chemical Industries, Ltd.), and 90 parts of ethyl acetate. The aqueous phase 1 is a milky whitish liquid.

Manufacture Example 3

Preparation of Resin B (Amorphous Low-Molecular-Weight Polyester)

A reaction vessel equipped with a condenser, a stirrer, and a nitrogen inlet pipe is charged with 450 parts of propylene oxide 2 mol adduct of bisphenol A, 280 parts of propylene oxide 3 mol adduct of bisphenol A, 247 parts of terephthalic acid, 75 parts of isophthalic acid, 10 parts of maleic anhydride, and 2 parts of titanium dihydroxybis(triethanolaminato) as a condensation catalyst. The mixture is subjected to a reaction at 220° C. for 8 hours under nitrogen gas flow while reducing by-product water. Further, the mixture is subjected to a reaction under reduced pressures of 5 to 20 mmHg. At the time the acid value becomes 8 mgKOH/g, the reaction product is taken out, cooled to room temperature, and pulverized. Thus, an amorphous low-molecular-weight polyester 1 is prepared. The amorphous low-molecular-weight polyester 1 has a number average molecular weight of 5,300, a weight average molecular weight of 25,600, a Tg of 59° C., and an acid value of 9.

Manufacture Example 4

Preparation of Resin B (Amorphous Intermediate Polyester)

A reaction vessel equipped with a condenser, a stirrer, and a nitrogen inlet pipe is charged with 680 parts of ethylene oxide 2 mol adduct of bisphenol A, 83 parts of propylene oxide 2 mol adduct of bisphenol A, 283 parts of terephthalic acid, 22 parts of trimellitic anhydride, and 2 parts of dibutyltin oxide. The mixture is subjected to a reaction at 230° C. for 7 hours under normal pressures and subsequent 5 hours under reduced pressures of 10 to 15 mmHg. Thus, an amorphous intermediate polyester 1 is prepared. The amorphous intermediate polyester 1 has a number average molecular weight of 2,400, a weight average molecular weight of 11,000, a Tg of 55° C., an acid value of 0.5, and a hydroxyl value of 52.

Another reaction vessel equipped with a condenser, a stirrer, and a nitrogen inlet pipe is charged with 410 parts of the amorphous intermediate polyester 1, 89 parts of isophorone diisocyanate, and 500 parts of ethyl acetate. The mixture is subjected to a reaction for 5 hours at 100° C. Thus, a prepolymer 1 is prepared. The prepolymer 1 includes 1.53% by weight of free isocyanates.

Manufacture Example 5

Preparation of Ketimine

A reaction vessel equipped with a stirrer and a thermometer is charged with 170 parts of isophoronediamine and 75 parts of methyl ethyl ketone. The mixture is subjected to a reaction for 4 hours and a half at 50° C. Thus, a ketimine compound 1 is prepared. The ketimine compound 1 has an amine value of 417 mgKOH/g.

Manufacture Example 6

Preparation of Master Batch

First, 100 parts of the amorphous low-molecular-weight polyester 1, 100 parts of a cyan pigment (C.I. Pigment Blue 15:3), and 100 parts of ion-exchange water are mixed with a HENSCHEL MIXER (from MITSUI MINING & SMELTING CO., LTD.). The mixture is kneaded with an open roll type kneader (KNEADEX from MITSUI MINING & SMELTING CO., LTD.).

After 1-hour kneading at 90° C., the kneaded mixture is cooled by rolling and then pulverized. Thus, a master batch 1 is prepared.

Manufacture Example 7

Preparation of Resin A (Crystalline Polyester Resin 1)

A reaction vessel equipped with a condenser, a stirrer, and a nitrogen inlet pipe is charged with 1,200 parts of 1,6-hexanediol, 1,200 parts of decanedioic acid, and 0.4 parts of dibutyltin oxide as a catalyst. The air in the vessel is replaced with an inert atmosphere of nitrogen gas by means of pressure reduction. Thereafter, the mixture is mechanically agitated at a revolution of 180 rpm for 5 hours. The mixture is gradually heated to 210° C. under reduced pressures and agitated for 1.5 hours. At the time the mixture becomes tenacious, the mixture is then air-cooled to terminate the reaction. Thus, a crystalline polyester 1 is prepared. The crystalline polyester 1 has a number average molecular weight of 3,400, a weight average molecular weight of 15,000, and a melting point of 64° C.

Manufacture Example 8

Preparation of Oily Phase 1

A reaction vessel equipped with a stirrer and a thermometer is charged with 530 parts of the amorphous low-molecular-weight polyester 1, 110 parts of a paraffin wax (having a melting point of 90° C.), 90 parts of the crystalline polyester 1, and 947 parts of ethyl acetate. The mixture is heated to 80° C. under agitation, kept at 80° C. for 5 hours, and gradually cooled to 30° C. over a period of 20 hours for crystal growth. The mixture is further mixed with 100 parts of the master batch 1 and 100 parts of ethyl acetate for 1 hour. Thus, a raw material liquid 1 is prepared.

Thereafter, 1,324 parts of the raw material liquid 1 are subjected to a dispersion treatment using a bead mill (ULTRAVISCOMILL (trademark) from Aimex Co., Ltd.) filled with 80% by volume of zirconia beads having a diameter of 0.5 mm, at a liquid feeding speed of 1 kg/hour and a disc peripheral speed of 6 m/sec. This dispersing operation is repeated 3 times (3 passes). Further, 1,324 parts of a 65% ethyl acetate solution of the amorphous low-molecular-weight polyester 1 are added and the resulting mixture is subjected to the above dispersing operation 6 times (6 passes). Thus, a colorant wax dispersion 1 is prepared. The solid content concentration in the colorant wax dispersion 1 is 50% (130° C., 30 minutes).

Manufacture Example 9

Emulsification and Solvent Removal

A vessel is charged with 749 parts of the colorant wax dispersion 1, 120 parts of the prepolymer 1, and 3.5 parts of the ketimine compound 1. The mixture is agitated by a TK HOMOMIXER (from PRIMIX Corporation) at a revolution of 5,000 rpm for 5 minutes. Further, 1,200 parts of the aqueous phase 1 are added to the vessel and the mixture is agitated by a TK HOMOMIXER at a revolution of 10,000 rpm for 3 hours. Thus, an emulsion slurry 1 is prepared.

The emulsion slurry 1 is contained in a vessel equipped with a stirrer and a thermometer and subjected to solvent removal for 8 hours at 30° C. and subsequent aging for 24 hours at 40° C. The emulsion slurry 1 is further subjected to an annealing (heat treatment) for crystal growth for 20 hours at 45° C. Thus, a dispersion slurry 1 is prepared.

Manufacture Example 10

Washing and Drying

After 100 parts of the dispersion slurry 1 are filtered under reduced pressures, the resulting wet cake is mixed with 100 parts of ion-exchange water using a TK HOMOMIXER for 10 minutes at a revolution of 12,000 rpm, followed by filtering, thus obtaining a wet cake (i).

The wet cake (i) is mixed with 100 parts of 10% aqueous solution of sodium hydroxide using a TK HOMOMIXER for 30 minutes at a revolution of 12,000 rpm, followed by filtering under reduced pressures, thus obtaining a wet cake (ii).

The wet cake (ii) is mixed with 100 parts of 10% hydrochloric acid using a TK HOMOMIXER for 10 minutes at a revolution of 12,000 rpm, followed by filtering, thus obtaining a wet cake (iii).

The wet cake (iii) is mixed with 300 parts of ion-exchange water using a TK HOMOMIXER for 10 minutes at a revolution of 12,000 rpm, followed by filtering. This operation is repeated twice, thus obtaining a wet cake 1.

The wet cake 1 is dried by a circulating air dryer for 48 hours at 45° C. and then filtered with a mesh having openings of 75 μm. Thus, a mother toner particle 1 is prepared.

The mother toner particle 1 in an amount of 100 parts is mixed with 1 part of a hydrophobized silica having a particle diameter of 13 nm by a HENSCHEL MIXER. Thus, a toner is prepared. Properties of the toner are shown in Tables 2-1 and 2-2. Evaluation results obtained with the test machine A are shown in Table 3.

TABLE 1

| | Oily Phase Materials (parts by weight) | | | | | Oily Phase Preparation Process Slow Cooling Process (1) No. | Emulsion Slurry Crystal Adjustment Adjustment Process (2) No. |
|---|---|---|---|---|---|---|---|
| | Resin A | Resin B | Wax | Master Batch | Ethyl Acetate | | |
| Ex. 1 | 90 | 530 | 110 | 100 | 1510 | 1 | 1 |
| Ex. 2 | 40 | 530 | 110 | 100 | 1510 | 2 | 2 |
| Ex. 3 | 40 | 530 | 110 | 100 | 1510 | 3 | 3 |
| Ex. 4 | 130 | 530 | 110 | 100 | 1510 | 2 | 2 |
| Ex. 5 | 130 | 530 | 110 | 100 | 1510 | 3 | 3 |
| Ex. 6 | 130 | 530 | 110 | 100 | 1510 | 3 | 3 |
| Comp. Ex. 1 | 30 | 530 | 110 | 100 | 1510 | 4 | 4 |
| Comp. Ex. 2 | 30 | 530 | 110 | 100 | 1510 | 5 | 5 |
| Comp. Ex. 3 | 160 | 530 | 110 | 100 | 1510 | 6 | 6 |
| Comp. Ex. 4 | 160 | 530 | 110 | 100 | 1510 | 5 | 5 |

TABLE 1-continued

| | Oily Phase Materials (parts by weight) | | | | | Oily Phase Preparation Process Slow Cooling Process (1) No. | Emulsion Slurry Crystal Adjustment Adjustment Process (2) No. |
|---|---|---|---|---|---|---|---|
| | Resin A | Resin B | Wax | Master Batch | Ethyl Acetate | | |
| Comp. Ex. 5 | 90 | 530 | 110 | 100 | 1510 | 7 | 7 |

(1) Slow Cooling Processes
No. 1: Gradually cool from 80° C. to 30° C. over a period of 20 hours
No. 2: Gradually cool from 80° C. to 30° C. over a period of 48 hours
No. 3: Gradually cool from 80° C. to 30° C. over a period of 10 hours
No. 4: Gradually cool from 80° C. to 30° C. over a period of 70 hours
No. 5: Gradually cool from 80° C. to 30° C. over a period of 2 hours
No. 6: Gradually cool from 80° C. to 30° C. over a period of 60 hours
No. 7: Gradually cool from 80° C. to 30° C. over a period of 1 hour
(2) Adjustment Processes
No. 1: Keep at 20° C. for 45 hours
No. 2: Keep at 50° C. for 48 hours
No. 3: Keep at 10° C. for 45 hours
No. 4: Keep at 70° C. for 47 hours
No. 5: Keep at 45° C. for 2 hours
No. 6: Keep at 48° C. for 60 hours
No. 7: Keep at 45° C. for 20 hours

TABLE 2-1

| | Long Axis of Resin A (nm) | Long Axis/Short Axis Ratio | DSC endothermic quantity of Resin A (J/g) | Core-Shell Structure | Content of Ethyl Acetate (μg/g) |
|---|---|---|---|---|---|
| Ex. 1 | 80 | 3 | 12 | Yes | 8 |
| Ex. 2 | 190 | 15 | 9 | Yes | 17 |
| Ex. 3 | 31 | 2 | 8 | Yes | 3 |
| Ex. 4 | 180 | 14 | 20 | Yes | 22 |
| Ex. 5 | 40 | 4 | 18 | Yes | 3 |
| Comp. Ex. 1 | 210 | 16 | 7 | Yes | 22 |
| Comp. Ex. 2 | 29 | 1 | 7 | Yes | 30 |
| Comp. Ex. 3 | 220 | 16 | 21 | Yes | 51 |
| Comp. Ex. 4 | 28 | 1 | 22 | Yes | 28 |
| Comp. Ex. 5 | 40 | 2 | 7 | Yes | 15 |

TABLE 2-2

| | | Particle Diameter | | |
|---|---|---|---|---|
| | Average Circularity | Weight Average Particle Diameter (D4) | Number Average Particle Diameter (Dn) | D4/Dn |
| Ex. 1 | 0.96 | 4.7 | 4.2 | 1.12 |
| Ex. 2 | 0.97 | 4.3 | 3.9 | 1.11 |
| Ex. 3 | 0.98 | 3.8 | 3.2 | 1.19 |
| Ex. 4 | 0.96 | 4.2 | 3.8 | 1.11 |
| Ex. 5 | 0.93 | 5.3 | 4.6 | 1.15 |
| Comp. Ex. 1 | 0.97 | 4.7 | 4.0 | 1.18 |
| Comp. Ex. 2 | 0.93 | 6.7 | 5.6 | 1.20 |
| Comp. Ex. 3 | 0.93 | 4.0 | 3.0 | 1.33 |
| Comp. Ex. 4 | 0.94 | 5.3 | 4.7 | 1.13 |
| Comp. Ex. 5 | 0.96 | 4.6 | 4.1 | 1.12 |

Example 2

The procedure for preparing toner in Example 1 is repeated except for changing the processes of preparation of oily phase and emulsification as follows. Thus, a toner is prepared. Toner manufacturing conditions are summarized in Table 1. Properties of the toner are shown in Tables 2-1 and 2-2. Evaluation results obtained with the test machine A are shown in Table 3.

TABLE 3

| | Low-temperature Fixability | Fluidity under High-temperature High-humidity Environment |
|---|---|---|
| Ex. 1 | B | B |
| Ex. 2 | C | B |
| Ex. 3 | A | C |
| Ex. 4 | C | C |
| Ex. 5 | A | C |
| Ex. 6 | C | C |
| Comp. Ex. 1 | D | C |
| Comp. Ex. 2 | B | D |
| Comp. Ex. 3 | D | D |
| Comp. Ex. 4 | B | D |

Preparation of Oily Phase

A reaction vessel equipped with a stirrer and a thermometer is charged with 530 parts of the amorphous low-molecular-weight polyester 1, 110 parts of a paraffin wax (having a melting point of 90° C.), 40 parts of the crystalline polyester 1, and 947 parts of ethyl acetate. The mixture is heated to 80° C. under agitation, kept at 80° C. for 5 hours, and gradually cooled to 30° C. over a period of 48 hours for crystal growth. The mixture is further mixed with 100 parts of the master batch 1 and 100 parts of ethyl acetate for 1 hour. Thus, a raw material liquid 2 is prepared.

Thereafter, 1,324 parts of the raw material liquid 2 are subjected to a dispersion treatment using a bead mill (ULTRAVISCOMILL (trademark) from Aimex Co., Ltd.) filled with 80% by volume of zirconia beads having a diameter of 0.5 mm, at a liquid feeding speed of 1 kg/hour and a disc peripheral speed of 6 m/sec. This dispersing operation is repeated 3 times (3 passes). Further, 1,324 parts of a 65% ethyl acetate solution of the amorphous low-molecular-weight polyester 1 are added and the resulting mixture is subjected to the above dispersing operation 6 times (6 passes). Thus, a colorant wax dispersion 2 is prepared. The solid content concentration in the colorant wax dispersion 2 is 50% (130° C., 30 minutes).

Emulsification and Solvent Removal

A vessel is charged with 749 parts of the colorant wax dispersion 2, 120 parts of the prepolymer 1, and 3.5 parts of the ketimine compound 1. The mixture is agitated by a TK HOMOMIXER (from PRIMIX Corporation) at a revolution of 5,000 rpm for 5 minutes. Further, 1,200 parts of the aqueous phase 1 are added to the vessel and the mixture is agitated by a TK HOMOMIXER at a revolution of 10,000 rpm for 3 hours. Thus, an emulsion slurry 2 is prepared.

The emulsion slurry 2 is contained in a vessel equipped with a stirrer and a thermometer and subjected to solvent removal for 8 hours at 30° C. and subsequent aging for 24 hours at 40° C. The emulsion slurry 2 is further subjected to a heat treatment for crystal growth for 50 hours at 48° C. Thus, a dispersion slurry 2 is prepared.

Example 3

The procedure for preparing toner in Example 1 is repeated except for changing the processes of preparation of oily phase and emulsification as follows. Thus, a toner is prepared. Toner manufacturing conditions are summarized in Table 1. Properties of the toner are shown in Tables 2-1 and 2-2. Evaluation results obtained with the test machine A are shown in Table 3.

Preparation of Oily Phase

A reaction vessel equipped with a stirrer and a thermometer is charged with 530 parts of the amorphous low-molecular-weight polyester 1, 110 parts of a paraffin wax (having a melting point of 90° C.), 40 parts of the crystalline polyester 1, and 947 parts of ethyl acetate. The mixture is heated to 80° C. under agitation, kept at 80° C. for 5 hours, and gradually cooled to 30° C. over a period of 10 hours for crystal growth. The mixture is further mixed with 100 parts of the master batch 1 and 100 parts of ethyl acetate for 1 hour. Thus, a raw material liquid 3 is prepared.

Thereafter, 1,324 parts of the raw material liquid 3 are subjected to a dispersion treatment using a bead mill (ULTRAVISCOMILL (trademark) from Aimex Co., Ltd.) filled with 80% by volume of zirconia beads having a diameter of 0.5 mm, at a liquid feeding speed of 1 kg/hour and a disc peripheral speed of 6 m/sec. This dispersing operation is repeated 3 times (3 passes). Further, 1,324 parts of a 65% ethyl acetate solution of the amorphous low-molecular-weight polyester 1 are added and the resulting mixture is subjected to the above dispersing operation 6 times (6 passes). Thus, a colorant wax dispersion 3 is prepared. The solid content concentration in the colorant wax dispersion 3 is 50% (130° C., 30 minutes).

Emulsification and Solvent Removal

A vessel is charged with 749 parts of the colorant wax dispersion 3, 120 parts of the prepolymer 1, and 3.5 parts of the ketimine compound 1. The mixture is agitated by a TK HOMOMIXER (from PRIMIX Corporation) at a revolution of 5,000 rpm for 5 minutes. Further, 1,200 parts of the aqueous phase 1 are added to the vessel and the mixture is agitated by a TK HOMOMIXER at a revolution of 10,000 rpm for 3 hours. Thus, an emulsion slurry 3 is prepared.

The emulsion slurry 3 is contained in a vessel equipped with a stirrer and a thermometer and subjected to solvent removal for 8 hours at 30° C. and subsequent aging for 24 hours at 40° C. The emulsion slurry 3 is further subjected to a heat treatment for crystal growth for 10 hours at 48° C. Thus, a dispersion slurry 3 is prepared.

Example 4

The procedure for preparing toner in Example 1 is repeated except for changing the processes of preparation of oily phase and emulsification as follows. Thus, a toner is prepared. Toner manufacturing conditions are summarized in Table 1. Properties of the toner are shown in Tables 2-1 and 2-2. Evaluation results obtained with the test machine A are shown in Table 3.

Preparation of Oily Phase

A reaction vessel equipped with a stirrer and a thermometer is charged with 530 parts of the amorphous low-molecular-weight polyester 1, 110 parts of a paraffin wax (having a melting point of 90° C.), 130 parts of the crystalline polyester 1, and 947 parts of ethyl acetate. The mixture is heated to 80° C. under agitation, kept at 80° C. for 5 hours, and gradually cooled to 30° C. over a period of 48 hours for crystal growth. The mixture is further mixed with 100 parts of the master batch 1 and 100 parts of ethyl acetate for 1 hour. Thus, a raw material liquid 4 is prepared.

Thereafter, 1,324 parts of the raw material liquid 4 are subjected to a dispersion treatment using a bead mill (ULTRAVISCOMILL (trademark) from Aimex Co., Ltd.) filled with 80% by volume of zirconia beads having a diameter of 0.5 mm, at a liquid feeding speed of 1 kg/hour and a disc peripheral speed of 6 m/sec. This dispersing operation is repeated 3 times (3 passes). Further, 1,324 parts of a 65% ethyl acetate solution of the amorphous low-molecular-weight polyester 1 are added and the resulting mixture is subjected to the above dispersing operation 6 times (6 passes). Thus, a colorant wax dispersion 4 is prepared. The solid content concentration in the colorant wax dispersion 4 is 50% (130° C., 30 minutes).

Emulsification and Solvent Removal

A vessel is charged with 749 parts of the colorant wax dispersion 4, 120 parts of the prepolymer 1, and 3.5 parts of the ketimine compound 1. The mixture is agitated by a TK HOMOMIXER (from PRIMIX Corporation) at a revolution of 5,000 rpm for 5 minutes. Further, 1,200 parts of the aqueous phase 1 are added to the vessel and the mixture is agitated by a TK HOMOMIXER at a revolution of 10,000 rpm for 3 hours. Thus, an emulsion slurry 4 is prepared.

The emulsion slurry 4 is contained in a vessel equipped with a stirrer and a thermometer and subjected to solvent removal for 8 hours at 30° C. and subsequent aging for 24 hours at 40° C. The emulsion slurry 4 is further subjected to a heat treatment for crystal growth for 50 hours at 48° C. Thus, a dispersion slurry 4 is prepared.

Example 5

The procedure for preparing toner in Example 1 is repeated except for changing the processes of preparation of oily phase and emulsification as follows. Thus, a toner is prepared. Toner manufacturing conditions are summarized in Table 1. Properties of the toner are shown in Tables 2-1 and 2-2. Evaluation results obtained with the test machine A are shown in Table 3.

Preparation of Oily Phase

A reaction vessel equipped with a stirrer and a thermometer is charged with 530 parts of the amorphous low-molecular-weight polyester 1, 110 parts of a paraffin wax (having a melting point of 90° C.), 130 parts of the crystalline polyester 1, and 947 parts of ethyl acetate. The mixture is heated to 80° C. under agitation, kept at 80° C. for 5 hours, and gradually cooled to 30° C. over a period of 10 hours for crystal growth. The mixture is further mixed with 100 parts of the master batch 1 and 100 parts of ethyl acetate for 1 hour. Thus, a raw material liquid 5 is prepared.

Thereafter, 1,324 parts of the raw material liquid 5 are subjected to a dispersion treatment using a bead mill (ULTRAVISCOMILL (trademark) from Aimex Co., Ltd.) filled with 80% by volume of zirconia beads having a diameter of 0.5 mm, at a liquid feeding speed of 1 kg/hour and a disc peripheral speed of 6 m/sec. This dispersing operation is repeated 3 times (3 passes). Further, 1,324 parts of a 65% ethyl acetate solution of the amorphous low-molecular-weight polyester 1 are added and the resulting mixture is subjected to the above dispersing operation 6 times (6 passes). Thus, a colorant wax dispersion 5 is prepared. The solid content concentration in the colorant wax dispersion 5 is 50% (130° C., 30 minutes).

Emulsification and Solvent Removal

A vessel is charged with 749 parts of the colorant wax dispersion 5, 120 parts of the prepolymer 1, and 3.5 parts of the ketimine compound 1. The mixture is agitated by a TK HOMOMIXER (from PRIMIX Corporation) at a revolution of 5,000 rpm for 5 minutes. Further, 1,200 parts of the aqueous phase 1 are added to the vessel and the mixture is agitated by a TK HOMOMIXER at a revolution of 10,000 rpm for 3 hours. Thus, an emulsion slurry 5 is prepared.

The emulsion slurry 5 is contained in a vessel equipped with a stirrer and a thermometer and subjected to solvent removal for 8 hours at 30° C. and subsequent aging for 24 hours at 40° C. The emulsion slurry 5 is further subjected to a heat treatment for crystal growth for 10 hours at 45° C. Thus, a dispersion slurry 5 is prepared.

Example 6

The toner of Example 1 is evaluated with the test machine B. Evaluation results are shown in Table 3.

Comparative Example 1

The procedure for preparing toner in Example 1 is repeated except for changing the processes of preparation of oily phase and emulsification as follows. Thus, a toner is prepared. Toner manufacturing conditions are summarized in Table 1. Properties of the toner are shown in Tables 2-1 and 2-2. Evaluation results obtained with the test machine A are shown in Table 3.

Preparation of Oily Phase

A reaction vessel equipped with a stirrer and a thermometer is charged with 530 parts of the amorphous low-molecular-weight polyester 1, 110 parts of a paraffin wax (having a melting point of 90° C.), 30 parts of the crystalline polyester 1, and 947 parts of ethyl acetate. The mixture is heated to 80° C. under agitation, kept at 80° C. for 5 hours, and gradually cooled to 30° C. over a period of 70 hours for crystal growth. The mixture is further mixed with 100 parts of the master batch 1 and 100 parts of ethyl acetate for 1 hour. Thus, a raw material liquid 6 is prepared.

Thereafter, 1,324 parts of the raw material liquid 6 are subjected to a dispersion treatment using a bead mill (ULTRAVISCOMILL (trademark) from Aimex Co., Ltd.) filled with 80% by volume of zirconia beads having a diameter of 0.5 mm, at a liquid feeding speed of 1 kg/hour and a disc peripheral speed of 6 m/sec. This dispersing operation is repeated 3 times (3 passes). Further, 1,324 parts of a 65% ethyl acetate solution of the amorphous low-molecular-weight polyester 1 are added and the resulting mixture is subjected to the above dispersing operation 6 times (6 passes). Thus, a colorant wax dispersion 6 is prepared. The solid content concentration in the colorant wax dispersion 6 is 50% (130° C., 30 minutes).

Emulsification and Solvent Removal

A vessel is charged with 749 parts of the colorant wax dispersion 6, 120 parts of the prepolymer 1, and 3.5 parts of the ketimine compound 1. The mixture is agitated by a TK HOMOMIXER (from PRIMIX Corporation) at a revolution of 5,000 rpm for 5 minutes. Further, 1,200 parts of the aqueous phase 1 are added to the vessel and the mixture is agitated by a TK HOMOMIXER at a revolution of 10,000 rpm for 3 hours. Thus, an emulsion slurry 6 is prepared.

The emulsion slurry 6 is contained in a vessel equipped with a stirrer and a thermometer and subjected to solvent removal for 8 hours at 30° C. and subsequent aging for 24 hours at 40° C. The emulsion slurry 6 is further subjected to a heat treatment for crystal growth for 70 hours at 48° C. Thus, a dispersion slurry 6 is prepared.

Comparative Example 2

The procedure for preparing toner in Example 1 is repeated except for changing the processes of preparation of oily phase and emulsification as follows. Thus, a toner is prepared. Toner manufacturing conditions are summarized in Table 1. Properties of the toner are shown in Tables 2-1 and 2-2. Evaluation results obtained with the test machine A are shown in Table 3.

Preparation of Oily Phase

A reaction vessel equipped with a stirrer and a thermometer is charged with 530 parts of the amorphous low-molecular-weight polyester 1, 110 parts of a paraffin wax (having a melting point of 90° C.), 30 parts of the crystalline polyester 1, and 947 parts of ethyl acetate. The mixture is heated to 80° C. under agitation, kept at 80° C. for 5 hours, and gradually cooled to 30° C. over a period of 2 hours for crystal growth. The mixture is further mixed with 100 parts of the master batch 1 and 100 parts of ethyl acetate for 1 hour. Thus, a raw material liquid 7 is prepared.

Thereafter, 1,324 parts of the raw material liquid 7 are subjected to a dispersion treatment using a bead mill (ULTRAVISCOMILL (trademark) from Aimex Co., Ltd.) filled with 80% by volume of zirconia beads having a diameter of 0.5 mm, at a liquid feeding speed of 1 kg/hour and a disc peripheral speed of 6 m/sec. This dispersing operation is repeated 3 times (3 passes). Further, 1,324 parts of a 65% ethyl acetate solution of the amorphous low-molecular-weight polyester 1 are added and the resulting mixture is subjected to the above dispersing operation 6 times (6 passes). Thus, a colorant wax dispersion 7 is prepared. The solid content concentration in the colorant wax dispersion 7 is 50% (130° C., 30 minutes).

Emulsification and Solvent Removal

A vessel is charged with 749 parts of the colorant wax dispersion 7, 120 parts of the prepolymer 1, and 3.5 parts of the ketimine compound 1. The mixture is agitated by a TK HOMOMIXER (from PRIMIX Corporation) at a revolution of 5,000 rpm for 5 minutes. Further, 1,200 parts of the aqueous phase 1 are added to the vessel and the mixture is agitated by a TK HOMOMIXER at a revolution of 10,000 rpm for 3 hours. Thus, an emulsion slurry 7 is prepared.

The emulsion slurry 7 is contained in a vessel equipped with a stirrer and a thermometer and subjected to solvent removal for 8 hours at 30° C. and subsequent aging for 24 hours at 40° C. The emulsion slurry 7 is further subjected to a heat treatment for crystal growth for 2 hours at 45° C. Thus, a dispersion slurry 7 is prepared.

Comparative Example 3

The procedure for preparing toner in Example 1 is repeated except for changing the processes of preparation of oily phase and emulsification as follows. Thus, a toner is prepared. Toner manufacturing conditions are summarized in Table 1. Properties of the toner are shown in Tables 2-1 and 2-2. Evaluation results obtained with the test machine A are shown in Table 3.

Preparation of Oily Phase

A reaction vessel equipped with a stirrer and a thermometer is charged with 530 parts of the amorphous low-molecular-weight polyester 1, 110 parts of a paraffin wax (having a melting point of 90° C.), 160 parts of the crystalline polyester 1, and 947 parts of ethyl acetate. The mixture is heated to 80° C. under agitation, kept at 80° C. for 5 hours, and gradually cooled to 30° C. over a period of 60 hours for crystal growth. The mixture is further mixed with 100 parts of the master batch 1 and 100 parts of ethyl acetate for 1 hour. Thus, a raw material liquid 8 is prepared.

Thereafter, 1,324 parts of the raw material liquid 8 are subjected to a dispersion treatment using a bead mill (ULTRAVISCOMILL (trademark) from Aimex Co., Ltd.) filled with 80% by volume of zirconia beads having a diameter of 0.5 mm, at a liquid feeding speed of 1 kg/hour and a disc peripheral speed of 6 m/sec. This dispersing operation is repeated 3 times (3 passes). Further, 1,324 parts of a 65% ethyl acetate solution of the amorphous low-molecular-weight polyester 1 are added and the resulting mixture is subjected to the above dispersing operation 6 times (6 passes). Thus, a colorant wax dispersion 8 is prepared. The solid content concentration in the colorant wax dispersion 8 is 50% (130° C., 30 minutes).

Emulsification and Solvent Removal

A vessel is charged with 749 parts of the colorant wax dispersion 8, 120 parts of the prepolymer 1, and 3.5 parts of the ketimine compound 1. The mixture is agitated by a TK HOMOMIXER (from PRIMIX Corporation) at a revolution of 5,000 rpm for 5 minutes. Further, 1,200 parts of the aqueous phase 1 are added to the vessel and the mixture is agitated by a TK HOMOMIXER at a revolution of 10,000 rpm for 3 hours. Thus, an emulsion slurry 8 is prepared.

The emulsion slurry 8 is contained in a vessel equipped with a stirrer and a thermometer and subjected to solvent removal for 8 hours at 30° C. and subsequent aging for 24 hours at 40° C. The emulsion slurry 8 is further subjected to a heat treatment for crystal growth for 60 hours at 48° C. Thus, a dispersion slurry 8 is prepared.

Comparative Example 4

The procedure for preparing toner in Example 1 is repeated except for changing the processes of preparation of oily phase and emulsification as follows. Thus, a toner is prepared. Toner manufacturing conditions are summarized in Table 1. Properties of the toner are shown in Tables 2-1 and 2-2. Evaluation results obtained with the test machine A are shown in Table 3.

Preparation of Oily Phase

A reaction vessel equipped with a stirrer and a thermometer is charged with 530 parts of the amorphous low-molecular-weight polyester 1, 110 parts of a paraffin wax (having a melting point of 90° C.), 160 parts of the crystalline polyester 1, and 947 parts of ethyl acetate. The mixture is heated to 80° C. under agitation, kept at 80° C. for 5 hours, and gradually cooled to 30° C. over a period of 2 hours for crystal growth. The mixture is further mixed with 100 parts of the master batch 1 and 100 parts of ethyl acetate for 1 hour. Thus, a raw material liquid 9 is prepared.

Thereafter, 1,324 parts of the raw material liquid 9 are subjected to a dispersion treatment using a bead mill (ULTRAVISCOMILL (trademark) from Aimex Co., Ltd.) filled with 80% by volume of zirconia beads having a diameter of 0.5 mm, at a liquid feeding speed of 1 kg/hour and a disc peripheral speed of 6 m/sec. This dispersing operation is repeated 3 times (3 passes). Further, 1,324 parts of a 65% ethyl acetate solution of the amorphous low-molecular-weight polyester 1 are added and the resulting mixture is subjected to the above dispersing operation 6 times (6 passes). Thus, a colorant wax dispersion 9 is prepared. The solid content concentration in the colorant wax dispersion 9 is 50% (130° C., 30 minutes).

Emulsification and Solvent Removal

A vessel is charged with 749 parts of the colorant wax dispersion 9, 120 parts of the prepolymer 1, and 3.5 parts of the ketimine compound 1. The mixture is agitated by a TK HOMOMIXER (from PRIMIX Corporation) at a revolution of 5,000 rpm for 5 minutes. Further, 1,200 parts of the aqueous phase 1 are added to the vessel and the mixture is agitated by a TK HOMOMIXER at a revolution of 10,000 rpm for 3 hours. Thus, an emulsion slurry 9 is prepared.

The emulsion slurry 9 is contained in a vessel equipped with a stirrer and a thermometer and subjected to solvent removal for 8 hours at 30° C. and subsequent aging for 24 hours at 40° C. The emulsion slurry 9 is further subjected to a heat treatment for crystal growth for 2 hours at 45° C. Thus, a dispersion slurry 9 is prepared.

Comparative Example 5

The procedure for preparing toner in Example 1 is repeated except for changing the processes of preparation of oily phase and emulsification as follows. Thus, a toner is prepared. Toner manufacturing conditions are summarized in Table 1. Properties of the toner are shown in Tables 2-1 and 2-2. Evaluation results obtained with the test machine A are shown in Table 3.

Preparation of Oily Phase

A reaction vessel equipped with a stirrer and a thermometer is charged with 530 parts of the amorphous low-molecular-weight polyester 1, 110 parts of a paraffin wax (having a melting point of 90° C.), 90 parts of the crystalline polyester 1, and 947 parts of ethyl acetate. The mixture is heated to 80° C. under agitation and then cooled to 30° C. without any treatment. The mixture is further mixed with 100 parts of the master batch 1 and 100 parts of ethyl acetate for 1 hour. Thus, a raw material liquid 10 is prepared.

Thereafter, 1,324 parts of the raw material liquid 10 are subjected to a dispersion treatment using a bead mill (ULTRAVISCOMILL (trademark) from Aimex Co., Ltd.) filled with 80% by volume of zirconia beads having a diameter of 0.5 mm, at a liquid feeding speed of 1 kg/hour and a disc peripheral speed of 6 m/sec. This dispersing operation is repeated 3 times (3 passes). Further, 1,324 parts of a 65% ethyl acetate solution of the amorphous low-molecular-weight polyester 1 are added and the resulting mixture is subjected to the above dispersing operation 6 times (6 passes). Thus, a colorant wax dispersion 10 is prepared. The solid content concentration in the colorant wax dispersion 10 is 50% (130° C., 30 minutes).

Emulsification and Solvent Removal

A vessel is charged with 749 parts of the colorant wax dispersion 10, 120 parts of the prepolymer 1, and 3.5 parts of the ketimine compound 1. The mixture is agitated by a TK HOMOMIXER (from PRIMIX Corporation) at a revolution of 5,000 rpm for 5 minutes. Further, 1,200 parts of the aqueous phase 1 are added to the vessel and the mixture is agitated by a TK HOMOMIXER at a revolution of 10,000 rpm for 3 hours. Thus, an emulsion slurry 10 is prepared.

The emulsion slurry 10 is contained in a vessel equipped with a stirrer and a thermometer and subjected to solvent removal for 8 hours at 30° C. and subsequent aging for 24 hours at 40° C. The emulsion slurry 10 is further subjected to a heat treatment for crystal growth for 20 hours at 45° C. Thus, a dispersion slurry 10 is prepared.

Evaluation Items

1) Low-Temperature Fixability Under High-Temperature and High-Humidity Environment Each of the above-prepared two-component developers is tested with the test machine A under a low-temperature and low-humidity environment, i.e., at 40° C. and 70% RH, to evaluate low-temperature fixability by printing images at various fixing temperatures changed in steps of 5° C. after printing a chart with 5% image area on 10,000 sheets of paper. The paper in use is a full-color PPC paper TYPE 6200 available from Ricoh Co., Ltd.

A printed image having an image density of 1.2, measured by a spectrometer X-RITE 938 (from X-Rite), is obtained by adjusting the fixing temperature of the fixing device. Each image printed at each fixing temperature is rubbed for 50 times by a crock meter equipped with a sand eraser. Image density is measured before and after the rubbing to calculate the fixation rate defined as follows.

Fixation rate (%)=(Image density after 50 times of rubbing with sand eraser)/(Image density before the rubbing)

The minimum fixable temperature is defined as a temperature at or above which the fixation rate equals or exceeds 80%. Criteria for determining low-temperature fixability are as follows.

A: The minimum fixable temperature is from 95 to 100° C., which is low. Very good.

B: The minimum fixable temperature is from 105 to 110° C., which is low. Good.

C: The minimum fixable temperature is from 115 to 130° C. Comparable to related art.

D: The minimum fixable temperature is from 135 to 170° C., which is high. Poor.

2) Evaluation of Fluidity Under High-Temperature and High-Humidity Environment

Fluidity is evaluated based on a measurement by a powder tester (PT-N from Hosokawa Micron Corporation) in a high-temperature and high-humidity environment, i.e., at 40° C. and 70% RH. Each toner is left in the above environment for 72 hours prior to the measurement. In the measurement, 2.0 g of each toner is get through sieves (plain-woven metallic meshes based on JIS Z8801-1) each having an opening of 150 μm, 75 μm, and 45 μm and the amount of residual toner remaining on each of the sieves is measured. Fluidity is determined by the following formula.

$$\text{Fluidity (\%)}=(A+0.6\times B+0.2\times C)/2.0\times 100$$

wherein A (g), B (g), and C (g) represent the amounts of residual toner remaining on the sieves having an opening of 150 μm, 75 μm, and 45 μm, respectively.

Fluidity is an index regarded as being better as the value lowers. Criteria are as follows.

A: not greater than 10

B: more than 10 and not greater than 20

C: more than 20 and not greater than 30

D: more than 30

What is claimed is:

1. A toner, comprising mother toner particles including:

a colorant;

a crystalline resin A, an amorphous resin B, and ethyl acetate in an amount of from 1 to 30 μg per 1 gram of the toner;

wherein the crystalline resin A is dispersed in the amorphous resin B in the state of phase separation, wherein a long axis of each dispersed particle of the crystalline resin A has a length of from 30 to 200 nm and a length ratio of the long axis to a short axis is from 2 to 15, and wherein a DSC endothermic quantity attributable to the crystalline resin A is from 8 to 20 J/g.

2. The toner according to claim 1, wherein each of the mother toner particles has a core-shell structure.

3. The toner according to claim 1, wherein the toner includes a polyester resin.

4. The toner according to claim 1, wherein the toner includes a modified polyester resin.

5. The toner according to claim 1, wherein the mother toner particles have an average circularity E of from 0.93 to 0.99.

6. The toner according to claim 1, wherein a weight average particle diameter D4 of the toner is from 2 to 7 μm and a ratio (D4/Dn) of the weight average particle diameter D4 to a number average particle diameter Dn of the toner is from 1.00 to 1.25.

7. The toner according to claim 1, wherein the toner is produced by a process including granulating in a medium containing water and/or an organic solvent.

8. The toner according to claim 1, wherein the mother toner particles are produced by a dissolution suspension method.

9. The toner according to claim 1, wherein the mother toner particles are produced by a dissolution suspension method accompanied by an elongation reaction.

10. The toner according to claim 1, wherein the mother toner particles are produced by dispersing and/or emulsifying an organic phase and/or monomer phase in an aqueous medium, the organic phase and/or monomer phase including raw materials and/or precursors of the mother toner particles.

11. The toner according to claim 1, wherein the mother toner particles are produced by subjecting a toner composition to a cross-linking and/or elongation reaction in an aqueous medium in the presence of fine resin particles, the toner composition including a polymer having a site reactive with a compound having an active hydrogen group, a polyester, a colorant, and a release agent.

12. A process cartridge, comprising:

a latent image bearing member;

a developing device; and the toner according to claim 1, wherein the process cartridge integrally supports the latent image bearing member and the developing device and is detachably attachable to image forming apparatus.

13. A two-component developer, comprising:

the toner according to claim 1; and a magnetic carrier.

14. The toner according to claim 1, having an average circularity of from 0.93 to 0.98.

15. The toner according to claim 1, wherein a long axis of the crystalline resin A is from 31 to 190 nm.

16. The toner according to claim 1, the ethyl acetate is present in an amount of from 3 to 22 μg per 1 gram of the toner.

* * * * *